US011391149B2

(12) United States Patent
Daher et al.

(10) Patent No.: US 11,391,149 B2
(45) Date of Patent: Jul. 19, 2022

(54) MINING MACHINE WITH ARTICULATING BOOM AND INDEPENDENT MATERIAL HANDLING SYSTEM

(71) Applicant: Joy Global Underground Mining LLC, Warrendale, PA (US)

(72) Inventors: Nagy Daher, Punchbowl (AU); Richard Boyd, Balgownie (AU); Edward Bagnall, Berrima (AU); Stuart Reeves, North Wollongong (AU)

(73) Assignee: JOY GLOBAL UNDERGROUND MINING LLC, Warrendale, PA (US)

( * ) Notice: Subject to any disclaimer, the term of this patent is extended or adjusted under 35 U.S.C. 154(b) by 0 days.

(21) Appl. No.: 17/126,960

(22) Filed: Dec. 18, 2020

(65) Prior Publication Data

US 2021/0102463 A1 Apr. 8, 2021

Related U.S. Application Data

(63) Continuation of application No. 15/680,637, filed on Aug. 18, 2017, now Pat. No. 10,876,400.
(Continued)

(51) Int. Cl.
*E21C 35/20* (2006.01)
*E21C 31/08* (2006.01)
(Continued)

(52) U.S. Cl.
CPC ..... *E21C 31/08* (2013.01); *E21C 31/10* (2013.01); *E21C 31/12* (2013.01); *E21C 35/20* (2013.01);
(Continued)

(58) Field of Classification Search
CPC ..... E21C 35/20; E21C 31/08; E21C 31/10; E21C 31/12; E21D 9/126; E21D 9/128; E21D 9/102; E21D 9/1026
See application file for complete search history.

(56) References Cited

U.S. PATENT DOCUMENTS 1,093,787 A 4/1914 Kuhn et al.
1,735,583 A 11/1929 Morgan
(Continued)

FOREIGN PATENT DOCUMENTS

AU 466244 B1 2/1972
CA 2141984 A1 8/1996
(Continued)

OTHER PUBLICATIONS

Chinese Patent Office Action for Application No. 201780062508.6 dated Feb. 2, 2021 (12 pages including English summary).
(Continued)

*Primary Examiner* — Janine M Kreck
(74) *Attorney, Agent, or Firm* — Michael Best & Friedrich LLP

(57) ABSTRACT

A cutting assembly for a rock excavation machine including a frame. The cutting assembly includes a boom supported on the frame and a cutting device. In some aspects, the boom includes a first portion and a second portion, and the first portion includes a first structure and a second structure slidable relative to the first structure. The second portion includes a first member pivotably coupled to the second structure, and a second member pivotably coupled to the first member. The cutting device is supported on the second member. In some aspects, a material handling device is supported independently of the boom and movable between a retracted position and an extended position independent of the boom.

18 Claims, 24 Drawing Sheets

Related U.S. Application Data

(60) Provisional application No. 62/398,834, filed on Sep. 23, 2016, provisional application No. 15/806,150, filed on Aug. 19, 2016.

(51) Int. Cl.

| | |
|---|---|
| ***E21C 31/10*** | (2006.01) |
| ***E21D 9/10*** | (2006.01) |
| ***E21D 9/12*** | (2006.01) |
| ***E21C 31/12*** | (2006.01) |
| *E21C 27/02* | (2006.01) |
| *E21C 25/06* | (2006.01) |
| *E21C 25/18* | (2006.01) |
| *E21C 27/12* | (2006.01) |
| *E21C 29/22* | (2006.01) |

(52) U.S. Cl.

CPC ..... *E21D 9/102* (2013.01); *E21D 9/1026* (2013.01); *E21D 9/126* (2013.01); *E21D 9/128* (2013.01); *E21C 25/06* (2013.01); *E21C 25/18* (2013.01); *E21C 27/02* (2013.01); *E21C 27/124* (2013.01); *E21C 29/22* (2013.01)

(56) References Cited

U.S. PATENT DOCUMENTS 1,953,326 A 4/1934 Morgan
2,336,335 A 12/1943 Zublin
2,336,337 A 12/1943 Zublin
2,517,267 A 8/1950 Watson
2,619,338 A 11/1952 Lindgren
2,619,339 A 11/1952 Cartlidge
2,654,586 A 10/1953 Berry
2,659,585 A 11/1953 McCallum
2,745,651 A 5/1956 Herrmann
2,756,039 A * 7/1956 Arthur ..... E21C 35/046 299/64
2,776,823 A 1/1957 Barrett
3,157,437 A 11/1964 Gonski
3,197,256 A 7/1965 Hlinsky
3,302,974 A 2/1967 Hlinsky
3,306,663 A * 2/1967 Webster ..... E21D 9/1033 299/31
3,353,871 A 11/1967 Arentzen
3,355,215 A 11/1967 Haspert et al.
3,408,109 A * 10/1968 Lockwood ..... E21C 35/20 299/56
3,412,816 A 11/1968 Lautsch
3,446,535 A 5/1969 Lauber
3,647,263 A 3/1972 Lauber et al.
3,663,054 A 5/1972 Dubois
3,729,056 A 4/1973 Paurat
3,719,404 A 6/1973 Sterner
3,840,271 A 10/1974 Sugden
3,922,017 A 11/1975 Cobb
3,929,378 A 12/1975 Frenyo et al.
3,966,258 A * 6/1976 Dolecki ..... E21C 31/10 299/76
3,972,571 A 8/1976 Benkowski
3,995,907 A 12/1976 Dubois
4,005,905 A 2/1977 Dubois
4,087,131 A 5/1978 Peterson et al.
4,096,917 A 6/1978 Harris
4,108,494 A 8/1978 Kogler
4,230,372 A 10/1980 Marten
4,248,481 A 2/1981 Stoltefuss
4,273,383 A 6/1981 Grisebach
4,302,054 A 11/1981 Haskew et al.
4,363,519 A * 12/1982 Howard ..... E21C 27/28 173/186
4,372,403 A 2/1983 Beeman
4,377,311 A 3/1983 Seller
4,470,635 A 9/1984 Paurat et al.
4,516,807 A 5/1985 Eagles
4,548,442 A 10/1985 Sugden et al.
4,589,701 A 5/1986 Beckmann et al.
4,643,483 A 2/1987 Brooks et al.
4,647,112 A 3/1987 Demoulin et al.
4,662,684 A 5/1987 Marten
4,682,819 A 7/1987 Masse
4,741,577 A 5/1988 Sato et al.
4,755,002 A 7/1988 Parrott
4,760,513 A 7/1988 Edwards
4,796,713 A 1/1989 Bechem
4,838,614 A 6/1989 Pentith et al.
4,838,615 A 6/1989 Oldham
4,848,486 A 7/1989 Bodine
4,878,714 A * 11/1989 Barnthaler ..... E21D 9/126 299/67
4,968,098 A 11/1990 Hirsch et al.
5,028,092 A 7/1991 Coski
5,050,934 A 9/1991 Brandl et al.
5,087,102 A 2/1992 Kiefer
5,112,111 A * 5/1992 Addington ..... E21C 27/24 299/18
5,190,353 A 3/1993 Bechem
5,205,612 A 4/1993 Sugden et al.
5,210,997 A 5/1993 Mountcastle, Jr.
5,234,257 A 8/1993 Sugden et al.
5,601,153 A 2/1997 Ensminger et al.
5,676,125 A 10/1997 Kelly et al.
5,697,733 A 12/1997 Marsh
5,938,288 A 8/1999 Saint-Pierre et al.
6,086,257 A 7/2000 Lee
6,561,590 B2 5/2003 Sugden
6,857,706 B2 2/2005 Hames et al.
6,938,702 B2 9/2005 Saha et al.
7,182,407 B1 2/2007 Peach et al.
7,325,882 B2 2/2008 Sugden et al.
7,384,104 B2 6/2008 Sugden
7,431,402 B2 10/2008 Peach et al.
7,490,911 B2 2/2009 Steinberg et al.
7,695,071 B2 4/2010 Jackson et al.
7,731,298 B2 6/2010 Merten et al.
7,934,776 B2 5/2011 de Andrade et al.
7,954,735 B2 6/2011 Belotserkovsky
8,079,647 B2 12/2011 Yao et al.
8,276,991 B2 10/2012 Thomson
8,328,292 B2 12/2012 de Andrade et al.
8,636,324 B2 1/2014 Skea
8,727,450 B2 5/2014 de Andrade et al.
9,470,087 B2 10/2016 Smith et al.
2002/0093239 A1 7/2002 Sugden
2005/0200192 A1 9/2005 Sugden et al.
2007/0090678 A1 4/2007 Peach et al.
2007/0193810 A1 8/2007 Steinberg et al.
2008/0156531 A1 7/2008 Boone et al.
2009/0058172 A1* 3/2009 de Andrade ..... E21C 27/20 299/55
2009/0066148 A1 3/2009 Willison
2009/0127918 A1 5/2009 Yao et al.
2010/0019563 A1 1/2010 Thomson
2010/0260563 A1 10/2010 Conroy et al.
2011/0062768 A1 3/2011 Van Zyl et al.
2011/0181097 A1 7/2011 Skea
2012/0098325 A1 4/2012 Junker et al.
2013/0057044 A1 3/2013 De Andrade et al.
2014/0077578 A1 3/2014 Smith et al.
2014/0091612 A1 4/2014 Rowher
2014/0178155 A1 6/2014 Feasey
2015/0152728 A1 6/2015 Hartwig et al.
2017/0204666 A1 7/2017 Galler et al.
2017/0211383 A1 7/2017 Lugg et al.
2017/0342829 A1 11/2017 De Sousa et al.
2018/0087379 A1 3/2018 Lugg et al.

FOREIGN PATENT DOCUMENTS

CL 35975 2/1988
CL 199900483 3/1999
CL 200901978 2/2010
CN 101778998 A 7/2010

(56) References Cited

FOREIGN PATENT DOCUMENTS

| | | | |
|---|---|---|---|
| CN | 101828004 | A | 9/2010 |
| CN | 102061914 | A | 5/2011 |
| CN | 102305067 | A | 1/2012 |
| CN | 102513998 | A | 6/2012 |
| CN | 102587911 | A | 7/2012 |
| CN | 102606154 | A | 7/2012 |
| CN | 102704927 | B | 10/2012 |
| CN | 102733803 | A | 10/2012 |
| CN | 202500560 | U | 10/2012 |
| CN | 202991028 | U | 6/2013 |
| CN | 103206213 | A | 7/2013 |
| CN | 103498671 | A | 1/2014 |
| CN | 104047603 | A | 9/2014 |
| CN | 104500086 | A | 4/2015 |
| CN | 204283458 | U | 4/2015 |
| DE | 4123307 | C1 | 12/1992 |
| DE | 4440261 | A1 | 5/1996 |
| DE | 19900906 | A1 | 7/2000 |
| EP | 176234 | A1 | 4/1986 |
| EP | 329915 | A1 | 8/1989 |
| GB | 2214963 | A | 9/1989 |
| JP | S5540058 | U | 3/1980 |
| JP | H02147793 | A | 6/1990 |
| RU | 2044125 | C1 | 9/1995 |
| RU | 2142561 | C1 | 12/1999 |
| RU | 2187640 | C1 | 8/2002 |
| RU | 2209979 | C2 | 8/2003 |
| RU | 2276728 | C1 | 5/2006 |
| RU | 2441155 | C1 | 1/2012 |
| SU | 323552 | A1 | 11/1972 |
| SU | 514097 | A1 | 5/1976 |
| SU | 581263 | A1 | 11/1977 |
| SU | 619117 | A3 | 8/1978 |
| SU | 750061 | A1 | 7/1980 |
| SU | 804832 | A1 | 2/1981 |
| SU | 962626 | A1 | 9/1982 |
| SU | 1328521 | A1 | 8/1987 |
| SU | 1712599 | A1 | 2/1992 |
| SU | 1731946 | A1 | 5/1992 |
| SU | 1744249 | A1 | 6/1992 |
| SU | 1779278 | C | 11/1992 |
| WO | 43637 | A1 | 7/2000 |
| WO | 46486 | A1 | 8/2000 |
| WO | 201045 | A1 | 1/2002 |
| WO | 2066793 | A1 | 8/2002 |
| WO | 2003062587 | A1 | 7/2003 |
| WO | 3089761 | A1 | 10/2003 |
| WO | 2012156843 | A2 | 9/2005 |
| WO | 2006075910 | A1 | 7/2006 |
| WO | 2016055087 | A1 | 4/2016 |

OTHER PUBLICATIONS

International Search Report and Written Opinion for Application No. PCT/US2017/047539 dated Oct. 31, 2017 (15 pages).

International Mining, "DynaCut Technology Achieving Breakthroughs," <https://im-mining.com/2015/12/17/dynacut-technology-achieving-breakthroughs/> web page accessed Nov. 22, 2019.

Mining3 Mining, "CRCMining Joy Global Oscillating Disc Cutter (ODC) Hard Rock Cutting Machine," <https://www.youtube.com/watch?v=anyPQWkH4rM> web page accessed Oct. 24, 2019.

Chilean Patent Office Search Report and Examiner's Report for Application No. 201900449 dated Mar. 10, 2020 (20 pages including statement of relevance).

Chinese Patent Office Action for Application No. 201780062508.6 dated Jun. 2, 2020 (12 pages including English summary).

Extended European Search Report issued by the European Patent Office for Application No. 17842188.9 dated Aug. 13, 2020 (13 pages).

Chilean Patent Office Search Report and Examiner's Response for Application No. 201900449 dated Sep. 10, 2020 (19 pages including statement of relevance).

Russian Patent Office Action for Application No. 2019107583 dated Nov. 16, 2020 (13 pages including English translation).

Russian Patent Office Action for Application No. 2019107583 dated Oct. 27, 2021 (18 pages including translation).

Chilean Patent Office Action for Application No. 202003217 dated Jan. 12, 2022 (22 pages, including English translation).

* cited by examiner

MINING MACHINE WITH ARTICULATING BOOM AND INDEPENDENT MATERIAL HANDLING SYSTEM

CROSS-REFERENCE TO RELATED APPLICATION

This application claims the benefit of prior-filed, co-pending U.S. patent application Ser. No. 15/680,637, filed Aug. 18, 2017, U.S. Provisional Patent Application No. 62/377,150, filed Aug. 19, 2016, and U.S. Provisional Patent Application No. 62/398,834, filed Sep. 23, 2016. The entire contents of these documents are incorporated by reference herein.

BACKGROUND

The present disclosure relates to mining and excavation machines, and in particular to a cutting device for a mining or excavation machine.

Hard rock mining and excavation typically requires imparting large energy on a portion of a rock face in order to induce fracturing of the rock. One conventional technique includes operating a cutting head having multiple mining picks. Due to the hardness of the rock, the picks must be replaced frequently, resulting in extensive down time of the machine and mining operation. Another technique includes drilling multiple holes into a rock face, inserting explosive devices into the holes, and detonating the devices. The explosive forces fracture the rock, and the rock remains are then removed and the rock face is prepared for another drilling operation. This technique is time-consuming and exposes operators to significant risk of injury due to the use of explosives and the weakening of the surrounding rock structure. Yet another technique utilizes roller cutting element(s) that rolls or rotates about an axis that is parallel to the rock face, imparting large forces onto the rock to cause fracturing.

SUMMARY

In one aspect, a cutting assembly for a rock excavation machine having a frame includes a boom supported on the frame and a cutting device. The boom includes a first portion and a second portion. The first portion includes a first structure and a second structure slidable relative to the first structure. The second portion includes a first member pivotably coupled to the second structure, and a second member pivotably coupled to the first member. The cutting device is supported on the second member.

In another aspect, a cutting assembly for a rock excavation machine having a frame includes a boom and a cutting device. The boom includes a first end supported on the frame and a second end. The boom further includes a first portion adjacent the first end and a second portion adjacent the second end. The second portion is supported for movement relative to the first end by a telescopic coupling and is pivotable relative to the first portion about an axis. The cutting device is supported on the second end of the boom.

In yet another aspect, a rock excavation machine includes a chassis, a boom supported on the chassis, a cutting device supported on the boom, and a material handling device supported on the chassis independently of the boom. At least a portion of the boom is movable relative to the chassis between a retracted position and an extended position. The material handling device is movable relative to the chassis between a retracted position and an extended position independent of the boom.

Other aspects will become apparent by consideration of the detailed description and accompanying drawings.

Figure 1:
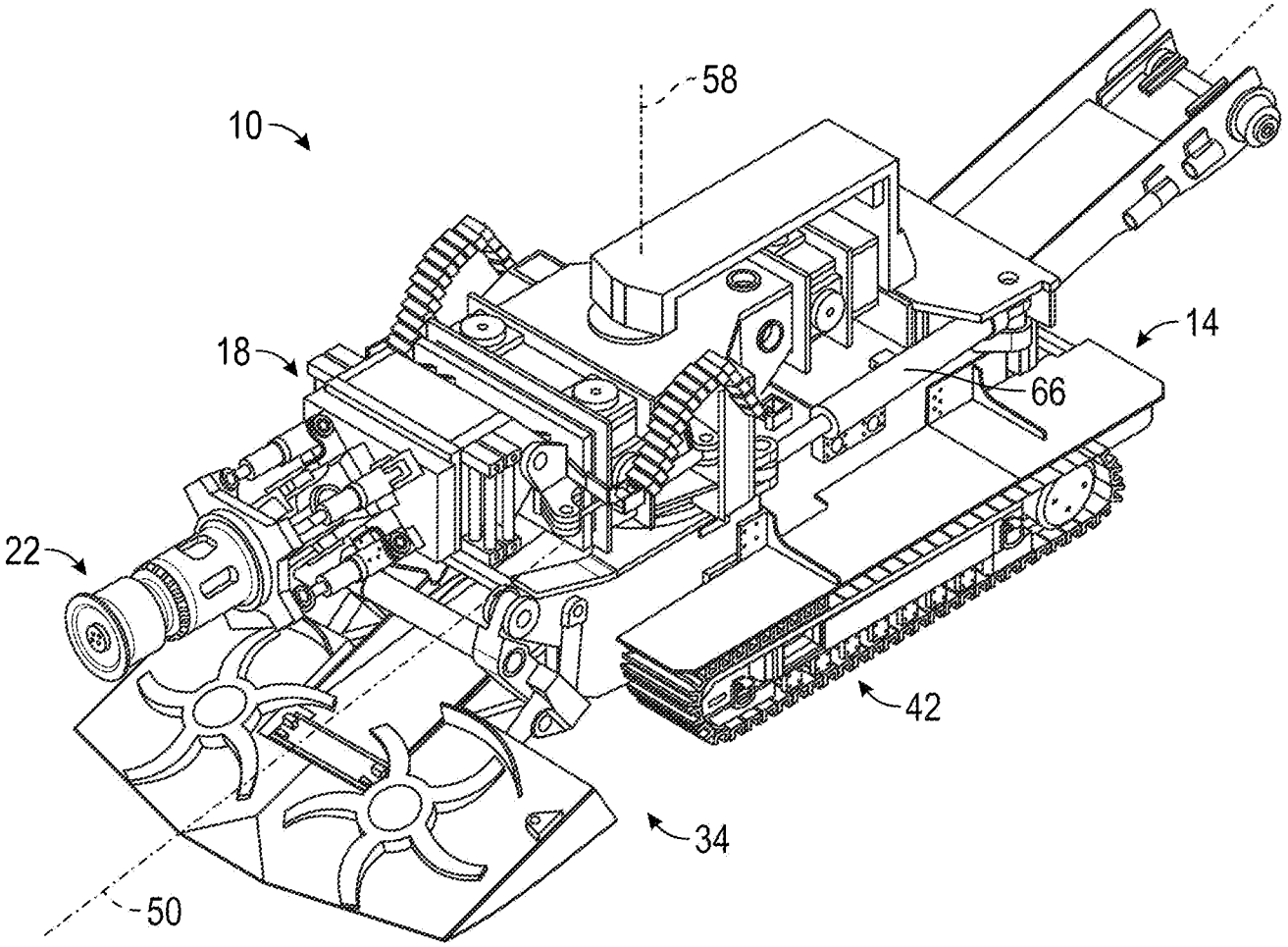
FIG. 1 is a perspective view of a mining machine.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or fluid connections or couplings, whether direct or indirect. Also, electronic communications and notifications may be performed using any known means including direct connections, wireless connections, etc.

DETAILED DESCRIPTION

FIGS. 1-4 illustrate a mining machine 10 (e.g., an entry development machine) including a chassis 14, a boom 18, a cutter head 22 for engaging a rock face 30 (FIG. 18), and a material handling system 34. In the illustrated embodiment, the chassis 14 is supported on a crawler mechanism 42 for movement relative to a floor (not shown). The chassis 14 includes a first or forward end and a second or rear end, and a longitudinal chassis axis 50 extends between the forward end and the rear end. The boom 18 is supported on the chassis 14 by a turntable or swivel joint 54. The swivel joint 54 (FIG. 2) is rotatable about a swivel axis 58 that is perpendicular to the chassis axis 50 (e.g., a vertical axis perpendicular to the support surface) to pivot the boom 18 in a plane that is generally parallel the chassis axis 50 (e.g., a horizontal plane parallel to the support surface). In the illustrated embodiment, the chassis 14 includes slew actuators or cylinders 66 for pivoting the swivel joint 54 and the boom 18 laterally about the swivel axis 58.

Figure 2:
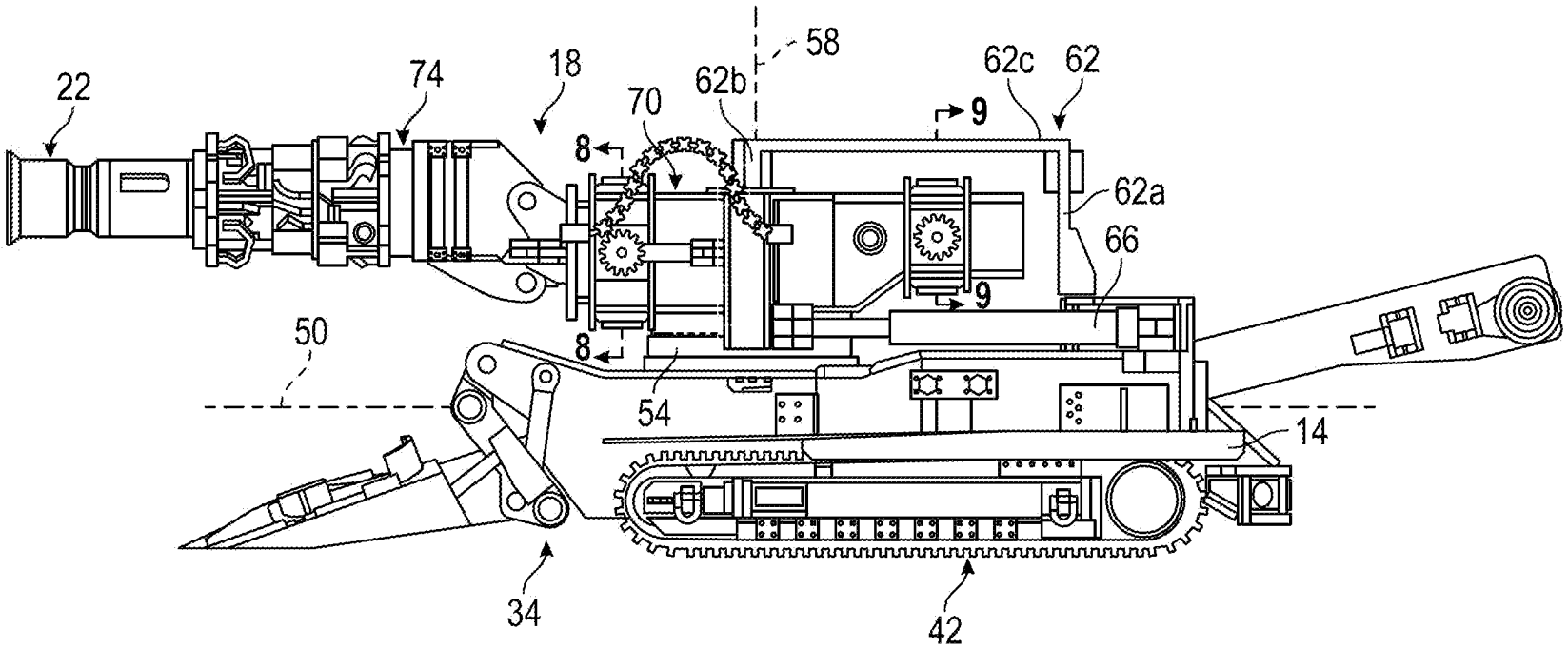
FIG. 2 is side view of the mining machine of FIG. 1.
Figure 3:
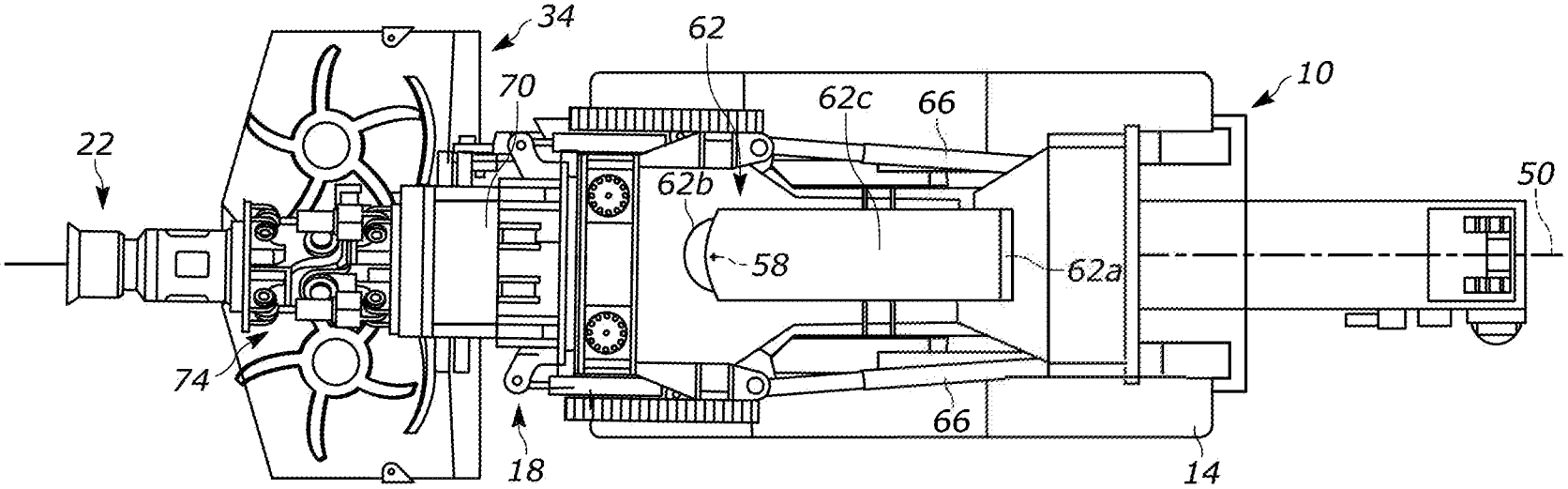
FIG. 3 is a top view of the mining machine of FIG. 1.
Figure 4:
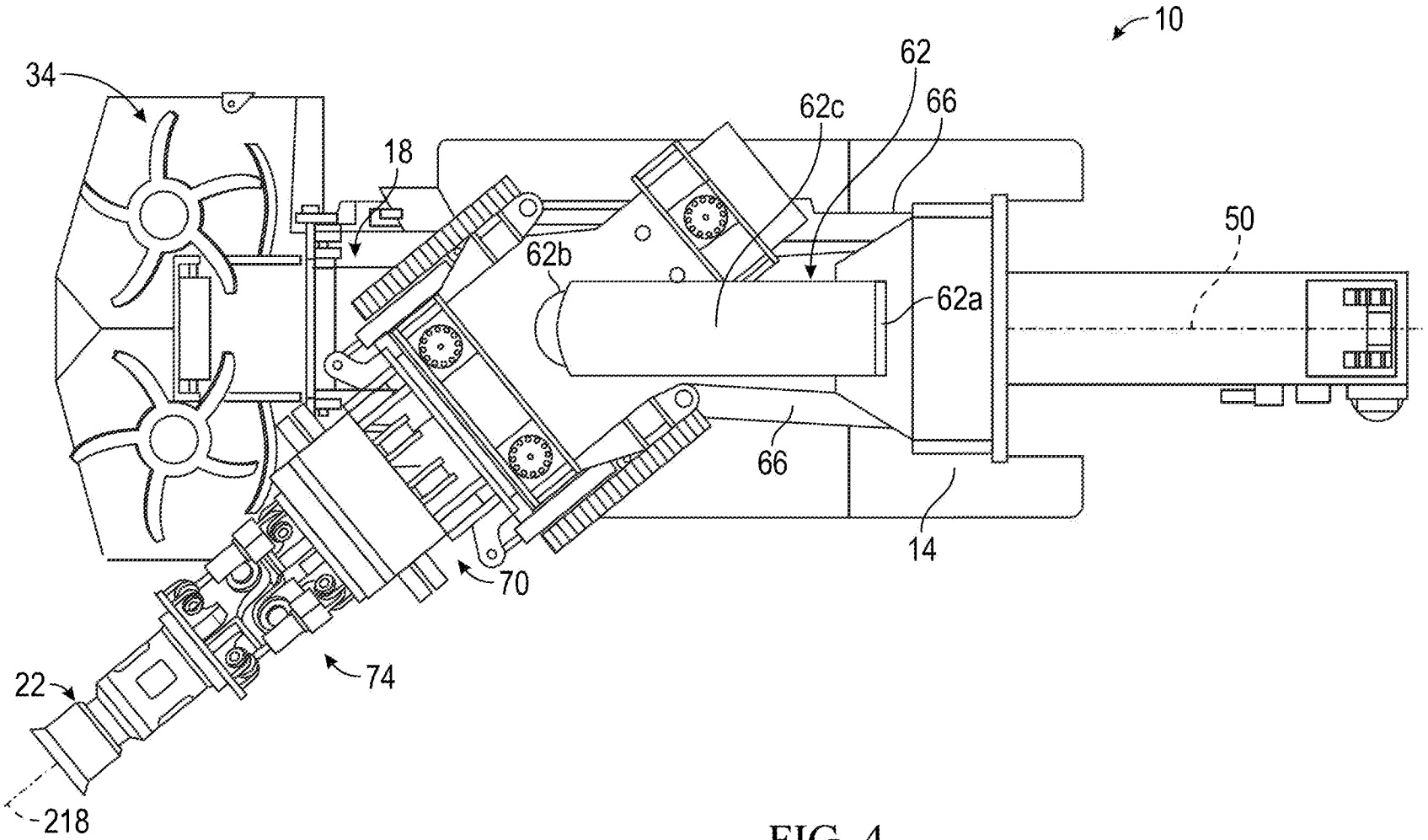
FIG. 4 is a top view of the mining machine of FIG. 1 with a boom in a pivoted position.

As shown in FIGS. 2-4, the machine 10 also includes a service support member or bridge 62 extending between the chassis 10 and the boom 18. In the illustrated embodiment, the bridge 62 includes a first portion 62*a* coupled to the chassis 14, a second portion 62*b* coupled to the boom 18, and an intermediate portion 68*c* coupled between the first portion 62*a* and the second portion 62*c*. The second portion 62*b* is substantially aligned with the swivel axis 58 but does not rotate with the boom 18. In some embodiments, a bearing (not shown) permits sliding movement between the second portion 62*b* and the boom 18. The intermediate portion 68*c* may be rigidly secured at each end to the first portion 68*a* and second portion 62*b*, respectively, or a coupling (e.g., a spherical joint) may permit some relative movement. The bridge 62 supports and/or guides various service lines (e.g., conduits, cables, wires, hoses, and pipes not shown) between the chassis 14 and the boom 18. The service lines may include electrical slip rings, rotary unions, or manifolds at connection points.

Figure 6:
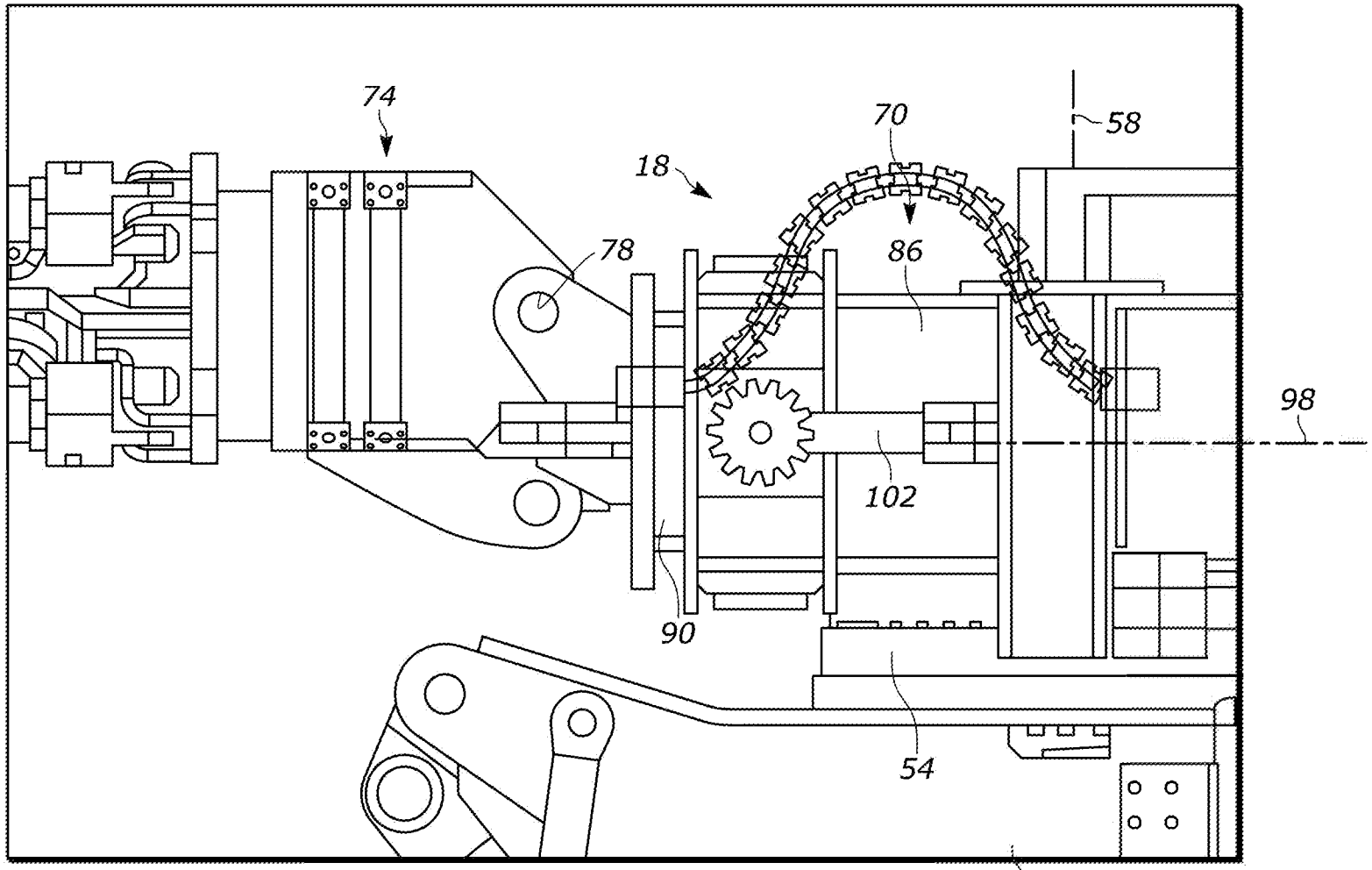
FIG. 6 is a side view of a portion of the boom in a retracted position.
Figure 7:
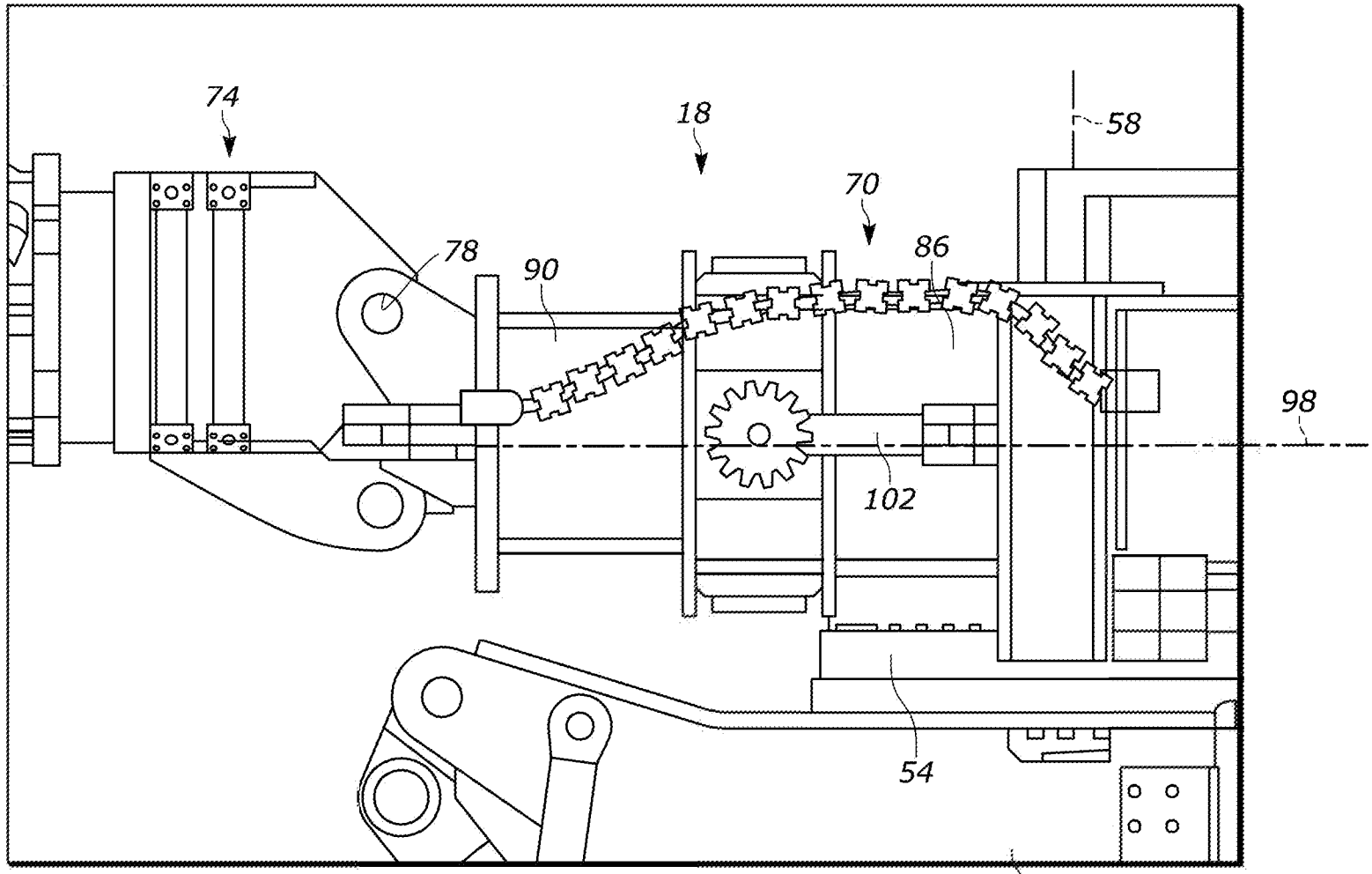
FIG. 7 is a side view of a portion of the boom in an extended position.

As shown in FIG. 2, the boom 18 includes a first portion or base portion 70 and a second portion or wrist portion 74 supporting the cutter head 22. Referring to FIGS. 6 and 7, in the illustrated embodiment, the wrist portion 74 is pivotably coupled to the base portion 70 by a pin joint 78. The base portion 70 includes a first or stationary structure 86 secured to the swivel joint 54 and a second or movable structure 90. The stationary structure 86 is pivotable with the swivel joint 54 and includes an opening 94 (FIG. 8) receiving the movable structure 90. The movable structure 90 is movable relative to the stationary structure 86 in a telescoping manner along a base axis 98. Linear actuators or slide actuators 102 (e.g., fluid cylinders) may be coupled between the stationary structure 86 and the movable structure 90 to move the movable structure 90 between a retracted position (FIG. 6) and an extended position (FIG. 7). The slide actuators 102 may be coupled to the exterior surfaces of the stationary structure 86 and the movable structure 90. In some embodiments, a sensor (e.g., a transducer—not shown) measures the stroke or position of the slide actuators 102.

Figure 8:
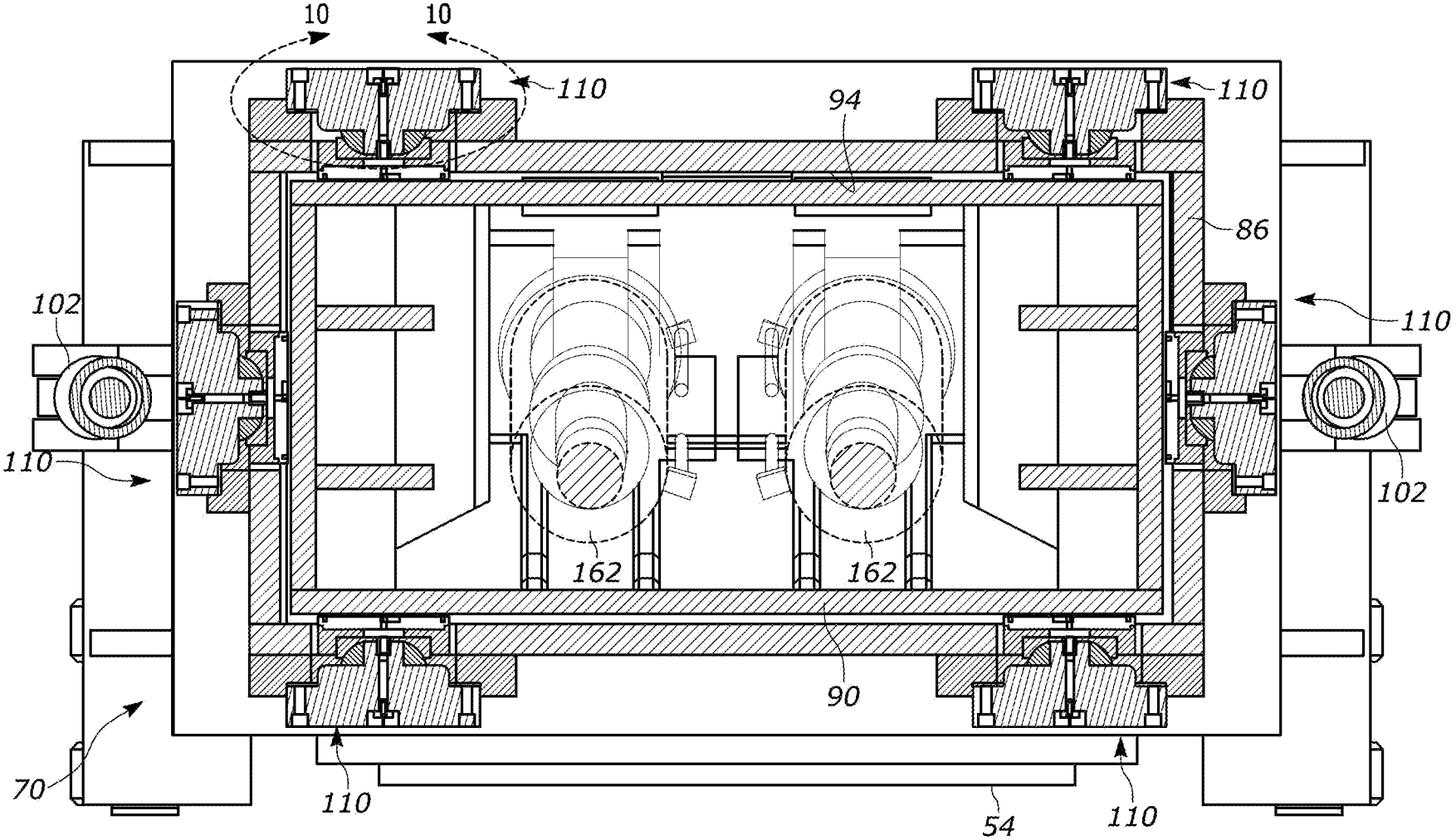
FIG. 8 is a cross-section view of a portion of the boom of FIG. 2, viewed along section 8-8.

As shown in FIG. 8, the movable structure 90 is supported relative to the stationary structure 86 by bearing assemblies 110. In the illustrated embodiment, six bearing assemblies 110 are located in a common plane normal to the base axis 98, with two bearing assemblies 110 abutting the upper and lower surfaces of the movable structure 90 and one bearing assembly 110 abutting each lateral surface of the movable structure 90.

Figure 9:
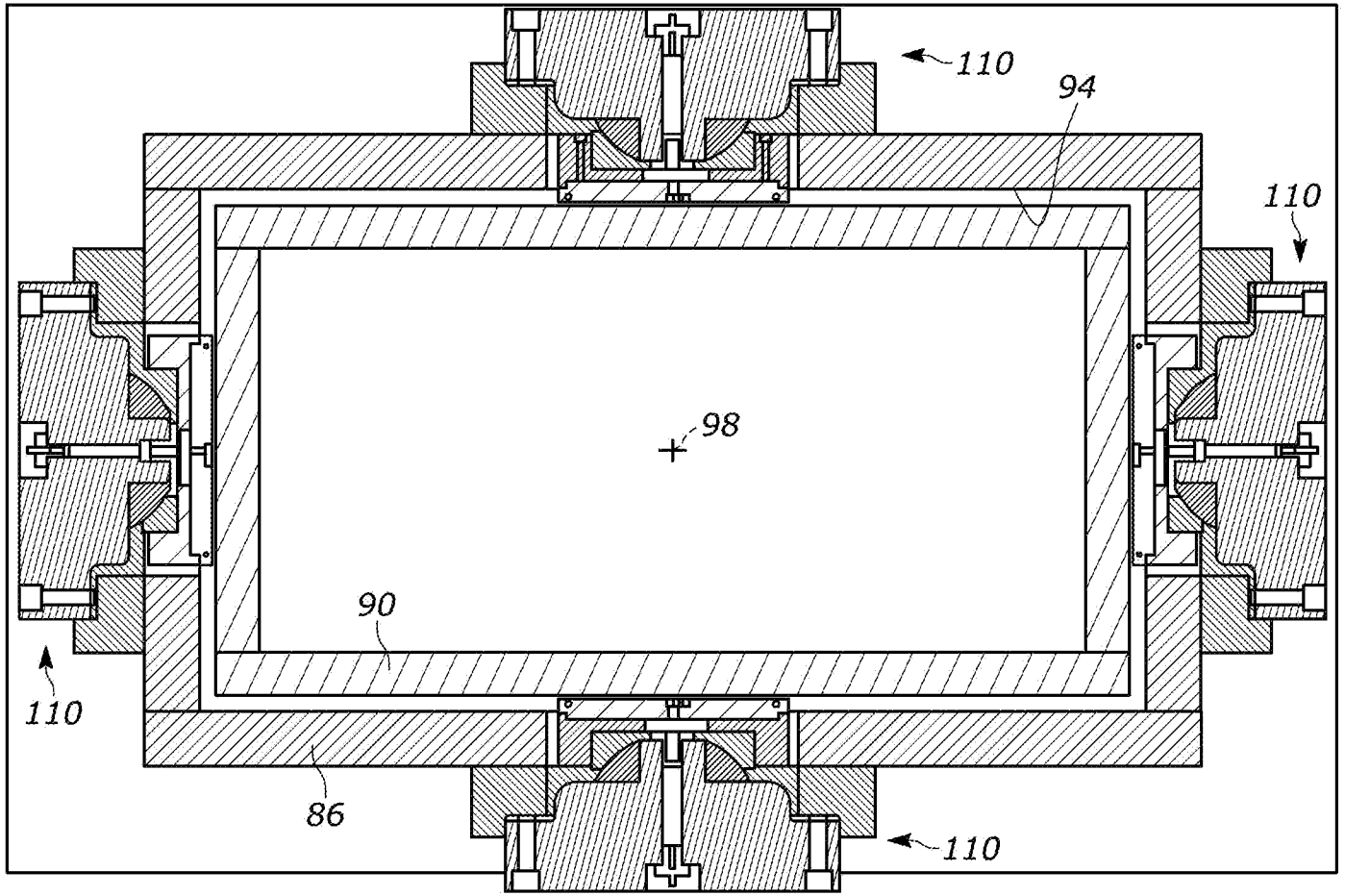
FIG. 9 is a cross-section view of a portion of the boom of FIG. 2, viewed along section 9-9.

As shown in FIG. 9, an additional set of bearing assemblies 110 may be positioned in a second plane normal to the base axis 98 and axially offset from the plane illustrated in FIG. 8. In the illustrated embodiment, the second set includes four bearing assemblies 110, with one bearing assembly 110 abutting each surface of the movable structure 90. In other embodiments, the base portion 70 may include fewer or more bearing assemblies 110, and the bearing assemblies 110 may be positioned in additional planes along the length of the base axis 98. The bearing assemblies 110 may be positioned in a different manner. In the illustrated embodiment, the bearing assemblies 110 are accessible from an outer surface of the boom 18; in other embodiments, the bearing assemblies 110 may be accessible only from an interior portion of the boom 18.

Figure 10:
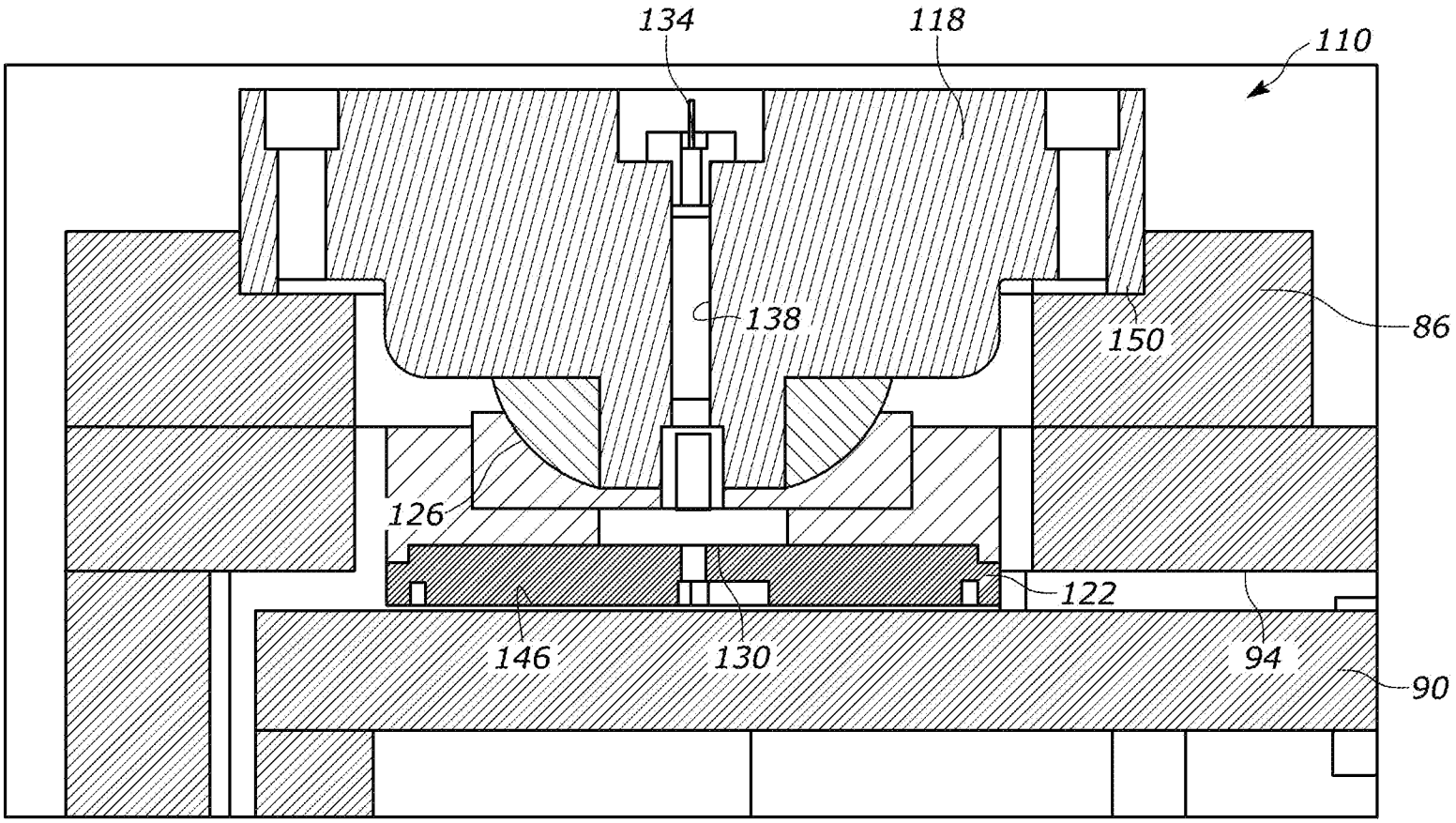
FIG. 10 is an enlarged view of portion 10-10 of the cross-section view of FIG. 8.

As shown in FIG. 10, each bearing assembly 110 includes a main support 118 secured to the base portion 70 and a pad 122 abutting a surface of the movable structure 90. In addition, a spherical bearing member 126 is coupled to the main support 118 to permit pivoting movement of the pad 122 relative to the main support 118. The pad 122 includes one or more pockets or chambers or galleries 130 formed in a surface of the pad 122 adjacent the movable structure 90. The main support 118 includes a port 134 and a passage 138 providing communication between the port 134 and galleries 130. The port 134 may receive a lubricant (e.g. grease) through a manual feed or an automatic lubrication system, and the lubricant may be transferred to the galleries 130 to lubricate the interface between the pad 122 and the movable structure 90. In addition, in the illustrated embodiment, a hard, low-friction bearing surface 146 is secured to an outer surface of the movable structure 90. The bearing surface 146 may be removably secured to the movable structure 90 (e.g., by fasteners) or attached by fusion (e.g., welding). The bearing assemblies 110 provide a low-friction interface and are capable of transmitting large forces caused by the cutting operation.

In addition, a shim pack 150 may be positioned between the main support 118 and the stationary structure 86 to adjust the position of the main support 118. A spring pack (not shown) may be positioned between the main support 118 and the spherical bearing member 126 to provide an initial load or preload to ensure that the pad 122 maintains positive contact with the movable structure 90 during operation. In other embodiments, other types of bearing assemblies may be used.

Figure 11:
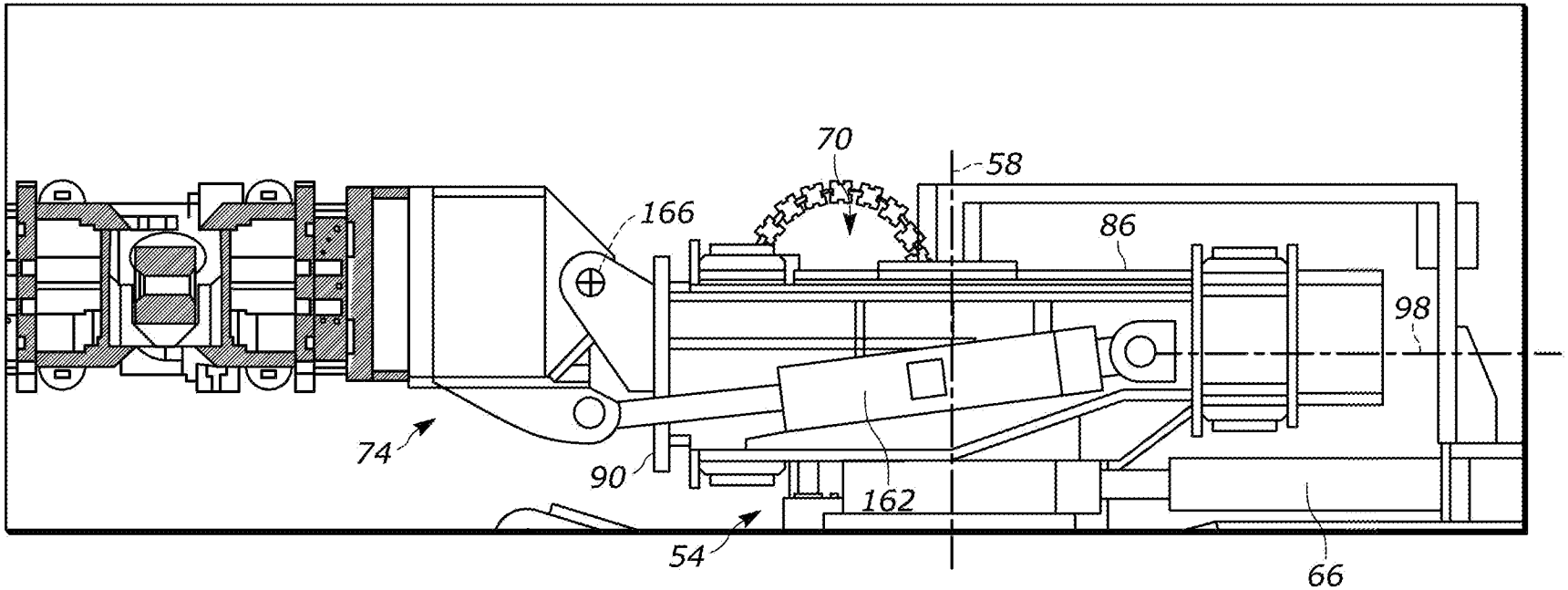
FIG. 11 is a cross-section view of a portion of the mining machine of FIG. 5, viewed along section 11-11.
Figure 12:
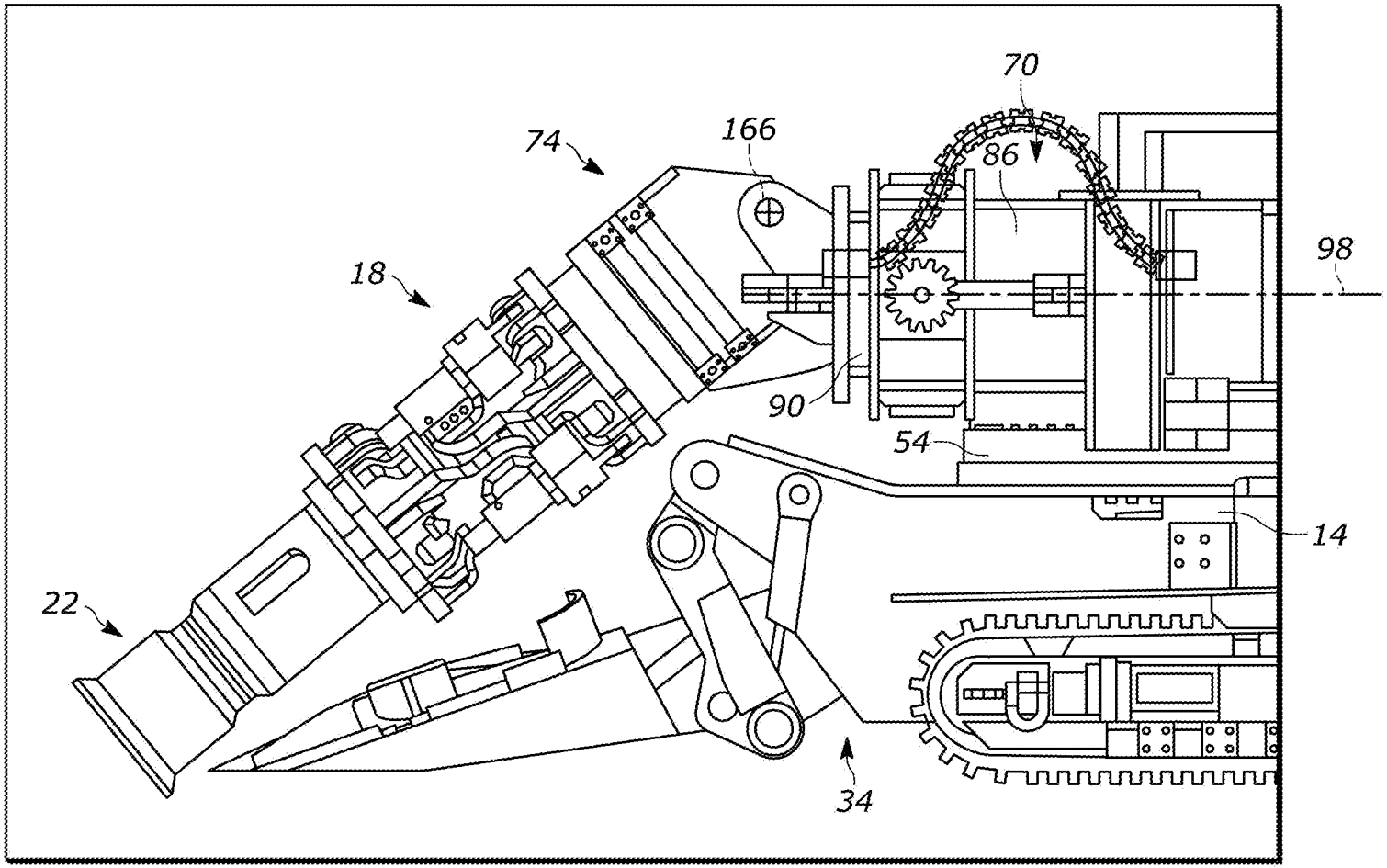
FIG. 12 is a side view of a portion of the mining machine with a boom in a lower position.
Figure 13:
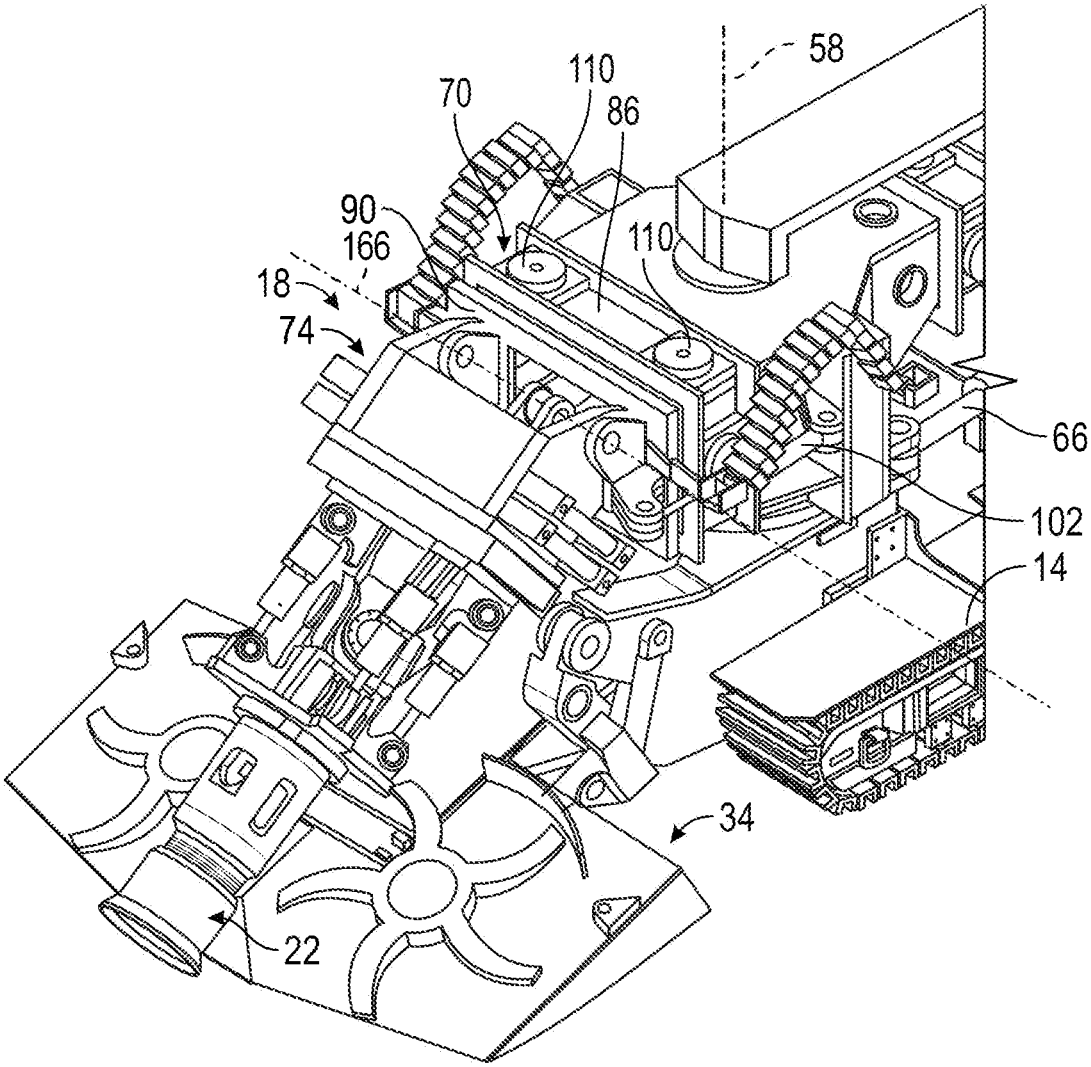
FIG. 13 is a perspective view of a portion of the mining machine of FIG. 12 with the boom in a lower position.
Figure 14:
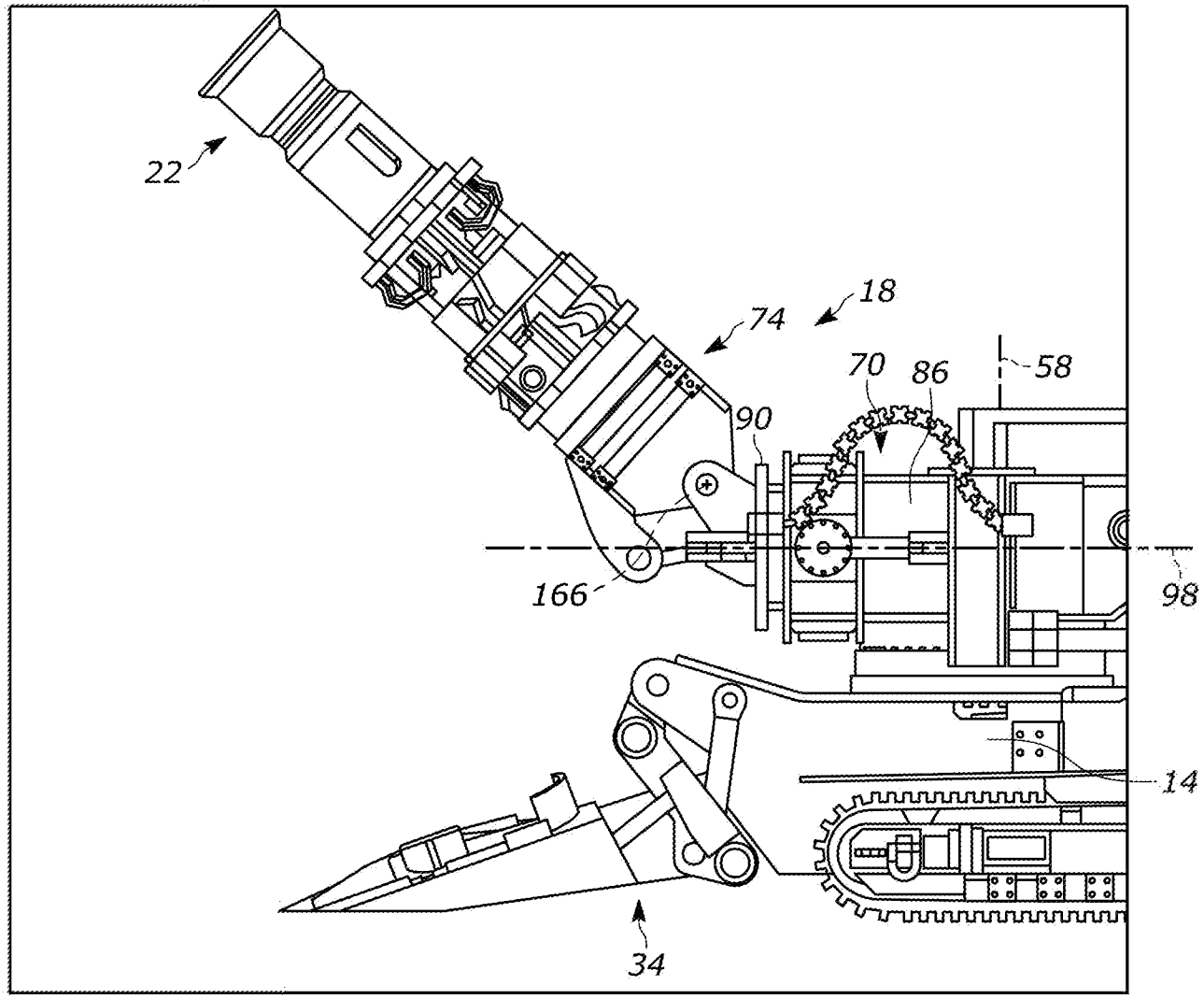
FIG. 14 is a side view of a portion of the mining machine with a boom in an upper position.
Figure 15:
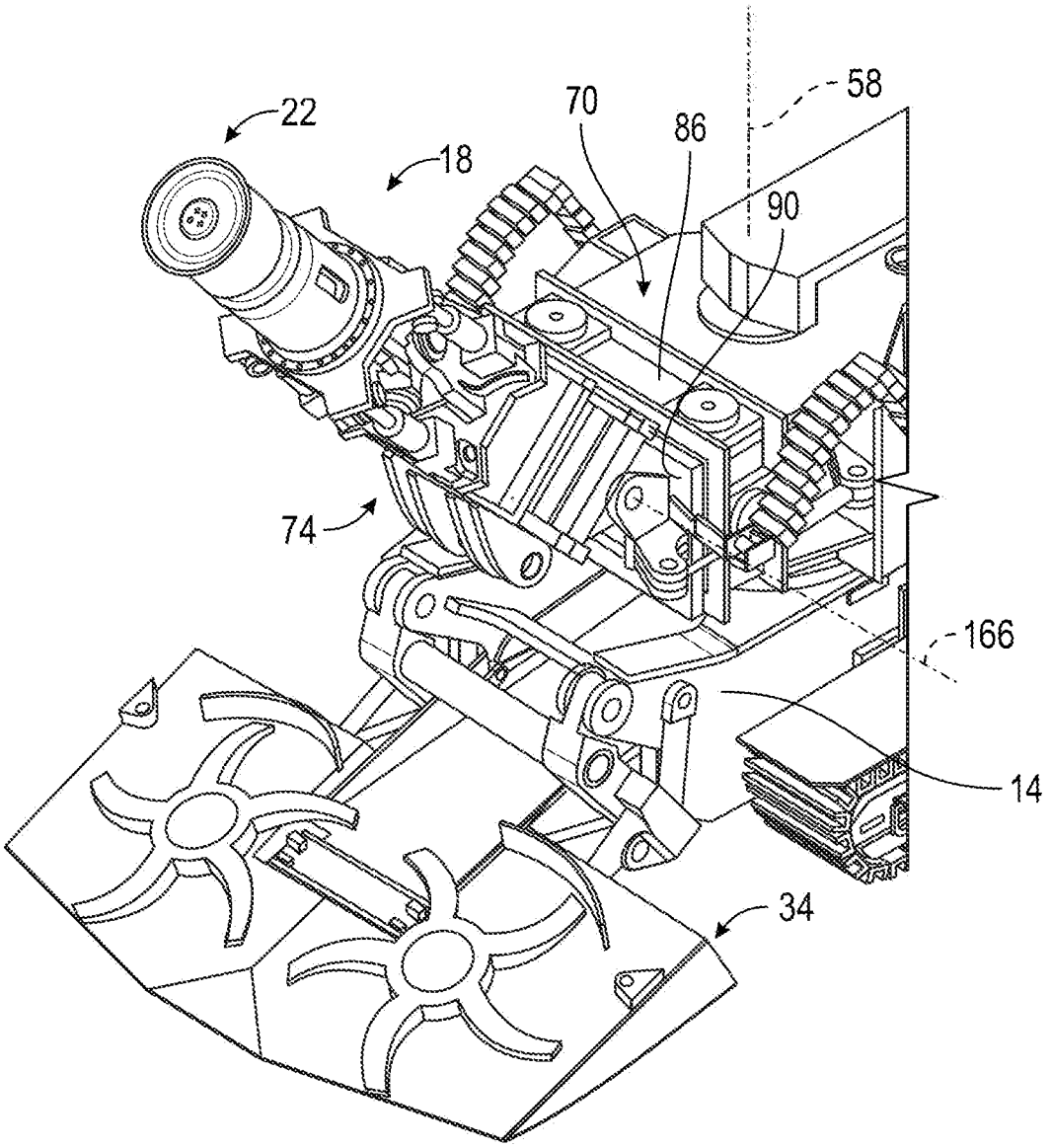
FIG. 15 is a perspective view of a portion of the mining machine of FIG. 14 with the boom in an upper position.

As shown in FIG. 11, the wrist portion 74 is pivotable relative to the base portion 70 due to operation of one or more fluid actuators (e.g., hydraulic cylinder) or luff actuators 162. In the illustrated embodiment, extension and retraction of the luff actuators 162 causes the wrist portion 74 to pivot about a transverse axis 166 that is perpendicular to the base axis 98. The wrist portion 74 may be pivoted between a first or lower position (FIGS. 12 and 13) and a second or upper position (FIGS. 14 and 15), or an intermediate position between the lower position and the upper position. Stated another way, the luff actuators 162 drive the wrist portion 74 to pivot in a plane that is parallel to the base axis 98 and the plane generally extends between an upper end of the machine 10 and a lower end of the machine 10.

In the illustrated embodiment, each luff actuator 162 includes a first end and a second end, with the first end coupled to the movable structure 90 of the base portion 70 and the second end coupled to the wrist portion 74. Each actuator 162 extends through the base portion 70 of the boom 18, such that the actuators 162 are positioned in the movable structure 90. Also, the transverse axis 166 may be offset from the base axis 98 such that the transverse axis 166 and the base axis 98 do not intersect each other. In the illustrated embodiment, the machine 10 includes two luff cylinders 162; in other embodiments, the machine 10 may include fewer or more actuators 162.

Figure 16:
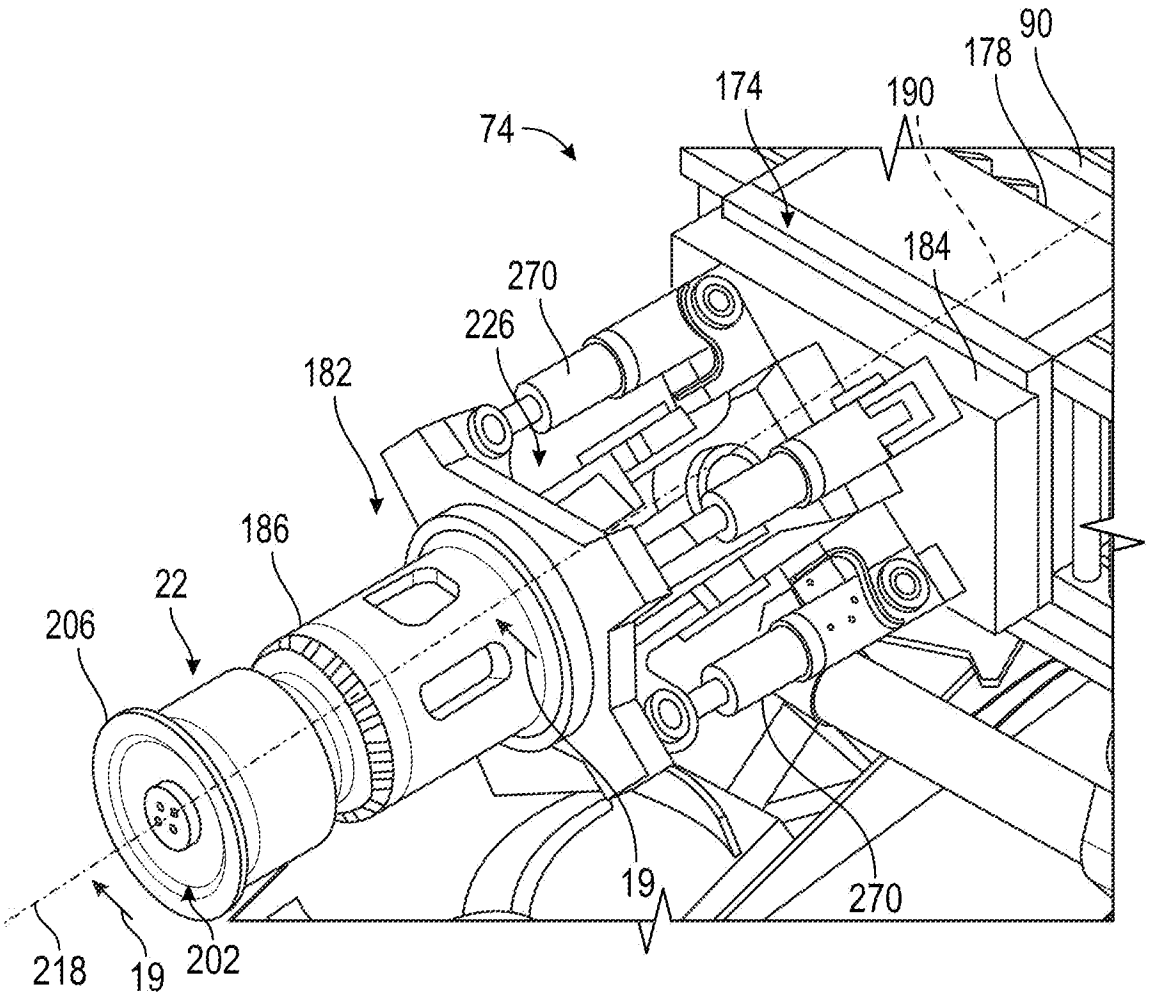
FIG. 16 is an enlarged perspective view of a cutter head.
Figure 17:
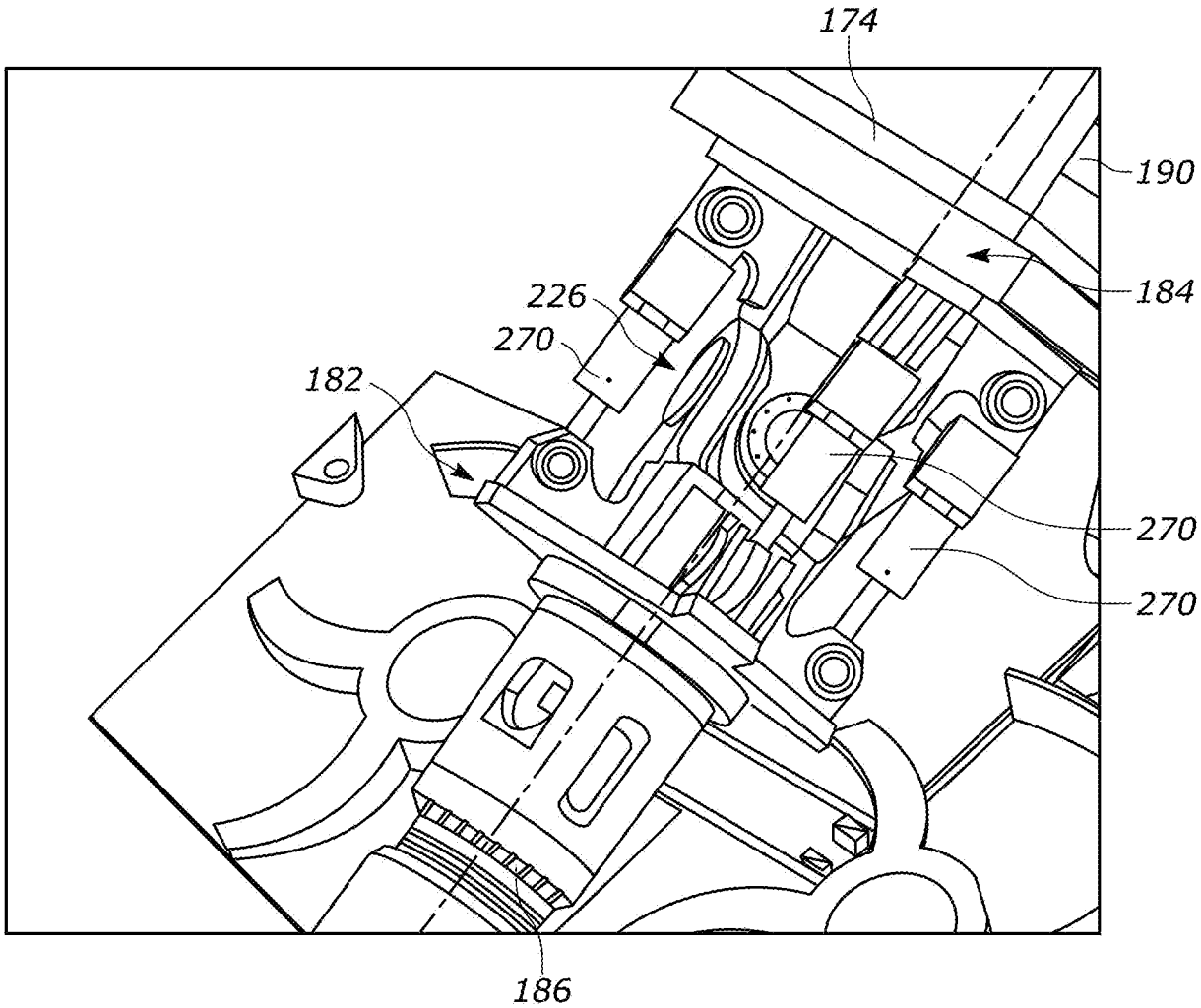
FIG. 17 is an enlarged perspective view of the cutter head of FIG. 16, with the boom in a lower position.

As shown in FIGS. 16 and 17, the wrist portion 74 includes a first member 174 proximate a first end 178 and a second member 182 proximate a second end 186, and a wrist axis 190 extends between the first end 178 and the second end 186. The first end 178 of the wrist portion 74 is coupled to the movable structure 90 of the base portion 70, and therefore the wrist portion 74 translates or telescopes with the movable structure 90 in a direction parallel to the base axis 98. The cutter head 22 (FIG. 16) is positioned adjacent the second end 186 of the wrist portion 74.

Figure 18:
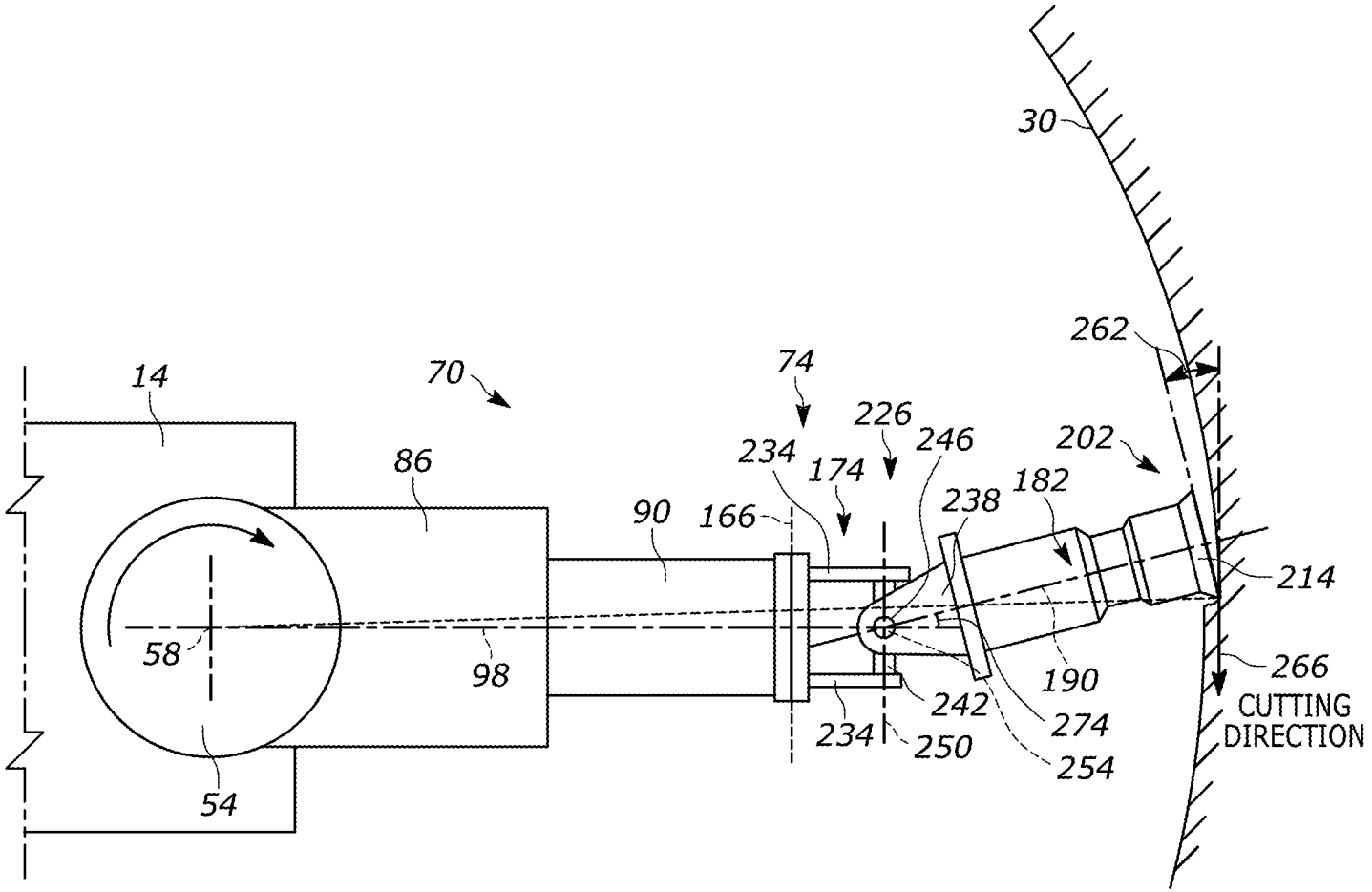
FIG. 18 is a schematic top view of a portion of the mining machine of FIG. 4, with a cutter head engaging a rock wall.

The cutter head 22 is positioned adjacent a distal end of the boom 18. As shown in FIG. 16, in the illustrated embodiment the cutter head 22 includes a cutting member or bit or cutting disc 202 having a peripheral edge 206, and a plurality of cutting bits 210 (FIG. 19) are positioned along the peripheral edge 206. The peripheral edge 206 may have a round (e.g., circular) profile, the cutting bits 210 may be positioned in a common plane defining a cutting plane 214 (FIG. 18). The cutting disc 202 may be rotatable about a cutter axis 218 that is generally perpendicular to the cutting plane 214. In the illustrated embodiment, the cutter axis 218 is aligned with the wrist axis 190 (FIG. 18).

As shown in FIG. 18, the wrist portion 74 includes a universal joint or U-joint 226 coupling the first member 174 and the second member 182. In particular, the first member 174 includes a pair of parallel first lugs 234 and the second member 182 includes a pair of parallel second lugs 238. A first shaft 242 extends between the first lugs 234 and a second shaft 246 extends between the second lugs 238 and is coupled to the first shaft 242. In some embodiments, the second shaft 246 is rigidly coupled to the first shaft 242. The first shaft 242 defines a first axis 250 that is substantially perpendicular to the wrist axis 190, and the second shaft 246 defines a second axis 254. The second axis 254 may be substantially perpendicular to the cutter axis 218 (FIG. 16). The first axis 250 and the second axis 254 are oriented perpendicular to each other. The universal joint 226 allows the second member 182 to pivot relative to the first member 174 about the first axis 250 and the second axis 254. Other aspects of universal joints are understood by a person of ordinary skill in the art and are not discussed in further detail. Among other things, the incorporation of the universal joint 226 permits the cutter head 22 to precess about the axes 250, 254 of the universal joint 226, and the joint 226 is capable of transferring shear and torque loads.

The cutter head 22 engages the rock face 30 by undercutting the rock face 30. The cutting disc 202 traverses across a length of the rock face 30 in a cutting direction 266. A leading portion of the cutting disc 202 engages the rock face 30 at a contact point and is oriented at an angle 262 relative to a tangent of the rock face 30 at the contact point. The cutting disc 202 is oriented at an acute angle 262 relative to a tangent of the rock face 30, such that a trailing portion of the cutting disc 202 (i.e., a portion of the disc 202 that is positioned behind the leading portion with respect to the cutting direction 266) is spaced apart from the face 30. The angle 262 provides clearance between the rock face 30 and a trailing portion of the cutting disc 202.

In some embodiments, the angle 262 is between approximately 0 degrees and approximately 25 degrees. In some embodiments, the angle 262 is between approximately 1 degree and approximately 10 degrees. In some embodiments, the angle 262 is between approximately 3 degrees and approximately 7 degrees. In some embodiments, the angle 262 is approximately 5 degrees.

Referring again to FIGS. 16 and 17, the wrist portion 74 further includes a suspension system for controlling movement of the second member 182 relative to the first member 174. In the illustrated embodiment, the suspension system includes multiple suspension actuators 270 (e.g., hydraulic cylinders). The suspension actuators 270 may be independently operated to maintain a desired offset angle 274 (FIG. 18) between the first member 174 and the second member 182. In addition, the suspension actuators 270 may be filled with fluid and act similar to springs to counteract the reaction forces exerted on the cutter head 22 by the rock face 30.

In the illustrated embodiment, the suspension system includes four fluid cylinders 270 spaced apart from one another about the wrist axis 190 by an angular interval of approximately 90 degrees. The cylinders 270 extend in a direction that is generally parallel to the wrist axis 190, but the cylinders 270 are positioned proximate the end of each of the first shaft 242 and the second shaft 246 of the universal joint 226. Each fluid cylinder 270 includes a first end coupled to the first member 174 and a second end coupled to the second member 182. The ends of each cylinder 270 may be connected to the first member 174 and the second member 182 by spherical couplings to permit pivoting movement. The suspension system transfers the cutting force as a moment across the universal joint 226, and controls the stiffness between the first member 174 and the second member 182.

In other embodiments, the suspension system may include fewer or more suspension actuators 270. The suspension actuators 270 may be positioned in a different configuration between the first member 174 and the second member 182. In still other embodiments, the suspension system may incorporate one or more mechanical spring element(s) either instead of or in addition to the fluid cylinders 270. Also, in some embodiments, a fluid manifold 184 (e.g., a sandwich manifold—FIGS. 16 and 17) may be positioned between the first member 174 and the universal joint 226 to provide fluid communication to the suspension actuators 270.

Figure 19:
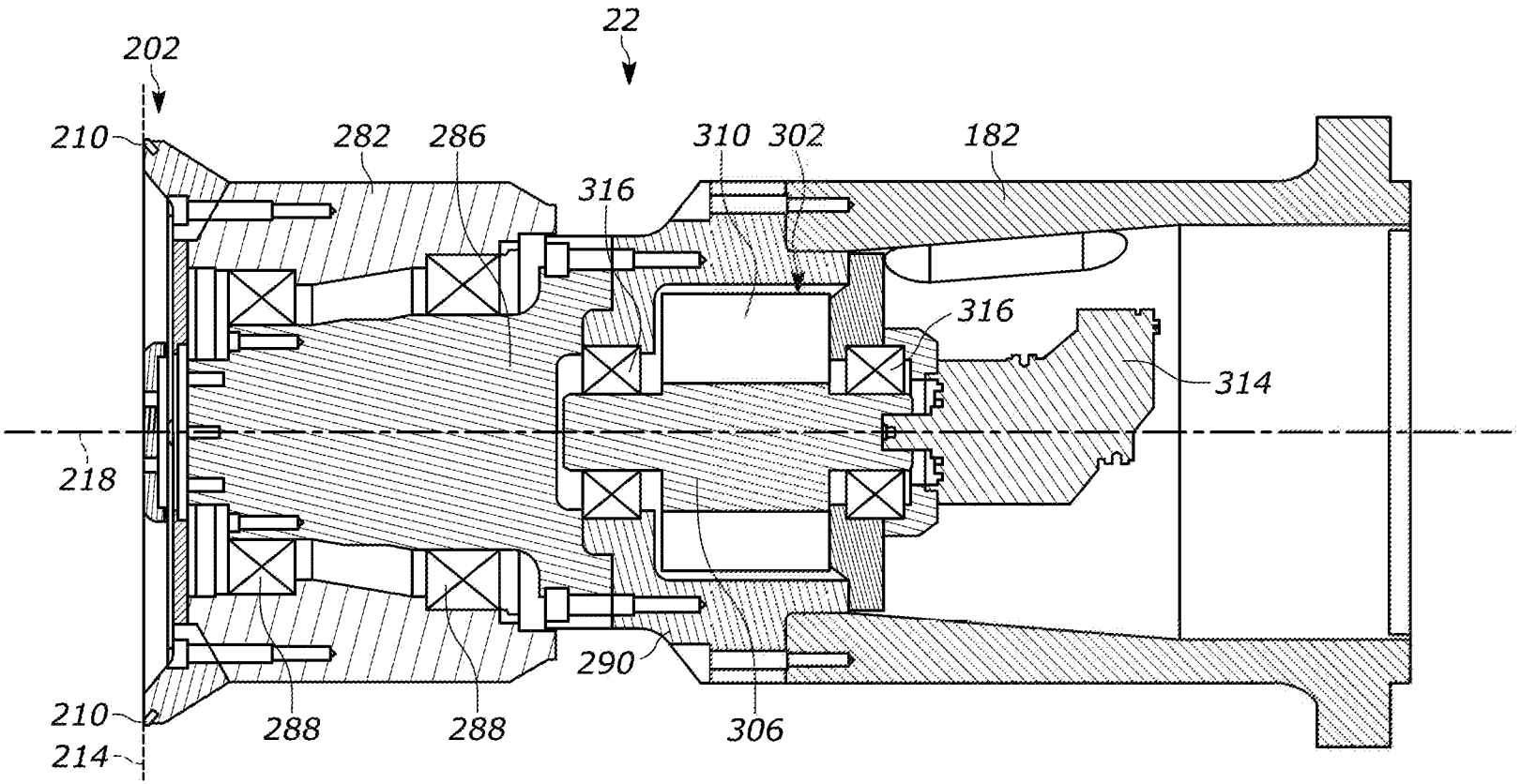
FIG. 19 is a cross-section view of the cutter head of FIG. 16, viewed along section 19-19.

As shown in FIG. 19, the cutter head 22 is positioned adjacent a second end 186 of the wrist portion 74 (FIG. 16). The cutting disc 202 is rigidly coupled to a carrier 282 that is supported on a shaft 286 for rotation (e.g., by straight or tapered roller bearings 288) about the cutter axis 218. The cutter head 22 further includes a housing 290. In the illustrated embodiment, the housing 290 is positioned between the second end 186 of the wrist portion 74 and the shaft 286, and the housing 290 is formed as a separate structure that is removably coupled to the second end 186 of the wrist portion 74 (e.g., by fasteners) and is removably coupled to the shaft 286 (e.g., by fasteners). In some embodiments, the housing 290 is formed as multiple separate sections that are coupled together.

The housing 290 supports an excitation element 302. The excitation element 302 includes an exciter shaft 306 and an eccentric mass 310 positioned on the exciter shaft 306. The exciter shaft 306 is driven by a motor 314 and is supported for rotation (e.g., by straight or tapered roller bearings 316) relative to the housing 290. The rotation of the eccentric mass 310 induces an eccentric oscillation in the housing 290, the shaft 286, and the cutting disc 202. The excitation element 302 and cutter head 22 may be similar to the exciter member and cutting bit described in U.S. Publication No. 2014/0077578, published Mar. 20, 2014, the entire contents of which are hereby incorporated by reference. In the illustrated embodiment, the cutting disc 202 is supported for free rotation relative to the shaft 286; that is, the cutting disc 202 is neither prevented from rotating nor positively driven to rotate except by the induced oscillation caused by the excitation element 302 and/or by the reaction forces exerted on the cutting disc 202 by the rock face 30.

Figure 5:
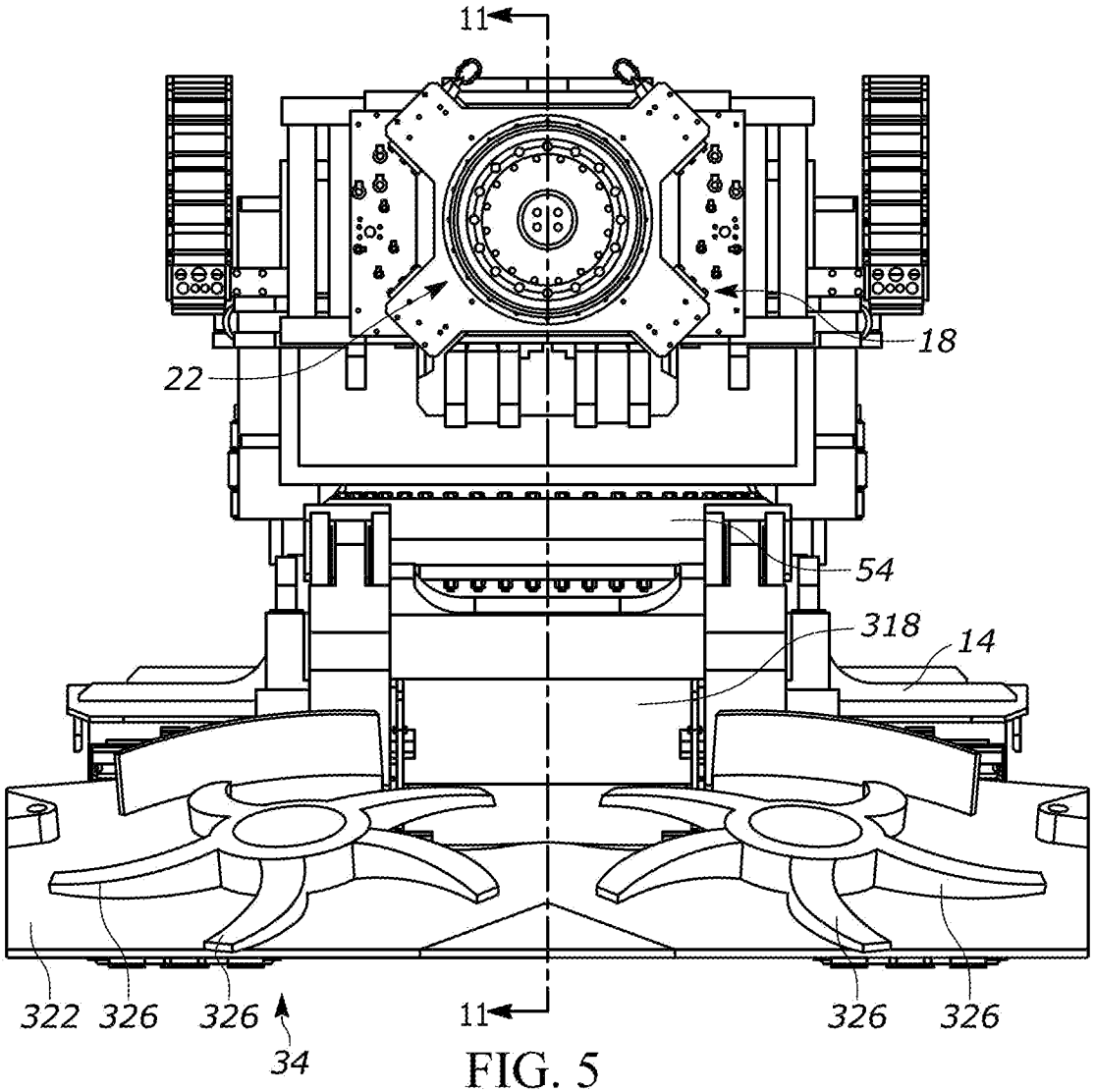
FIG. 5 is a front view of the mining machine of FIG. 1.
Figure 20:
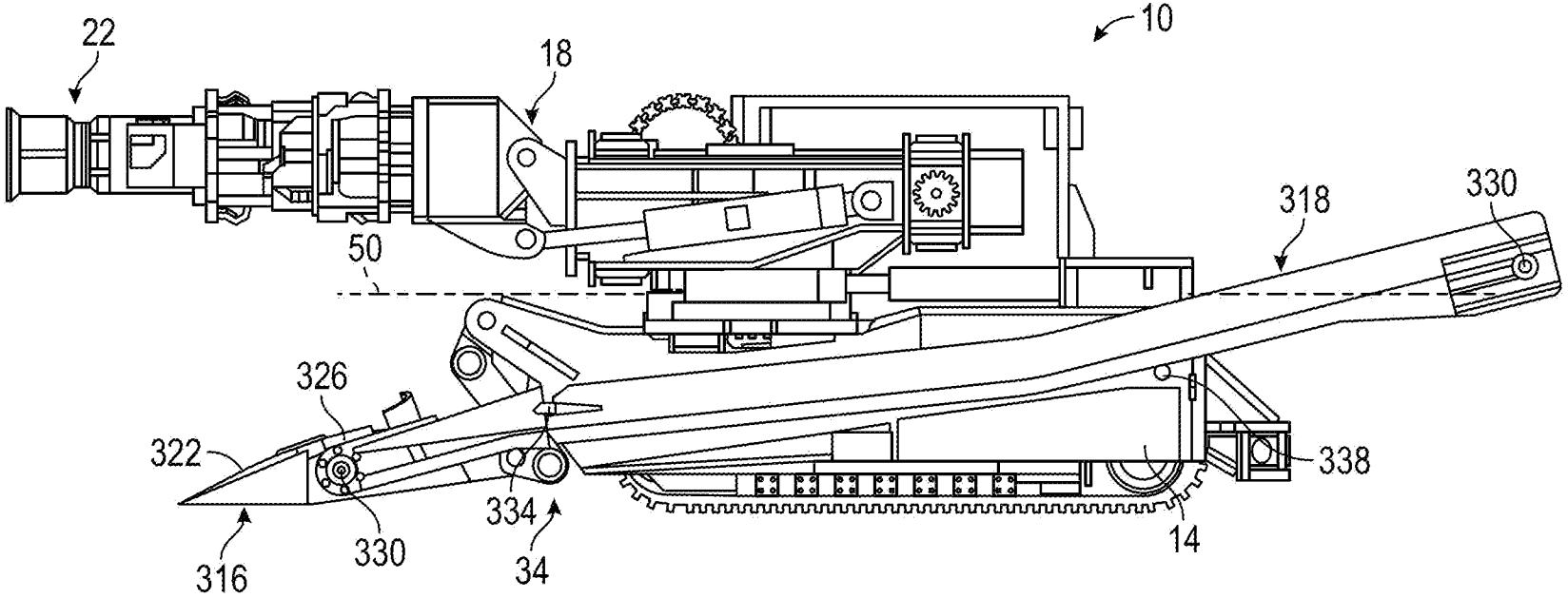
FIG. 20 is a cross-section view of the mining machine of FIG. 5, viewed along section 11-11, with the gathering head in a retracted position.
Figure 24:
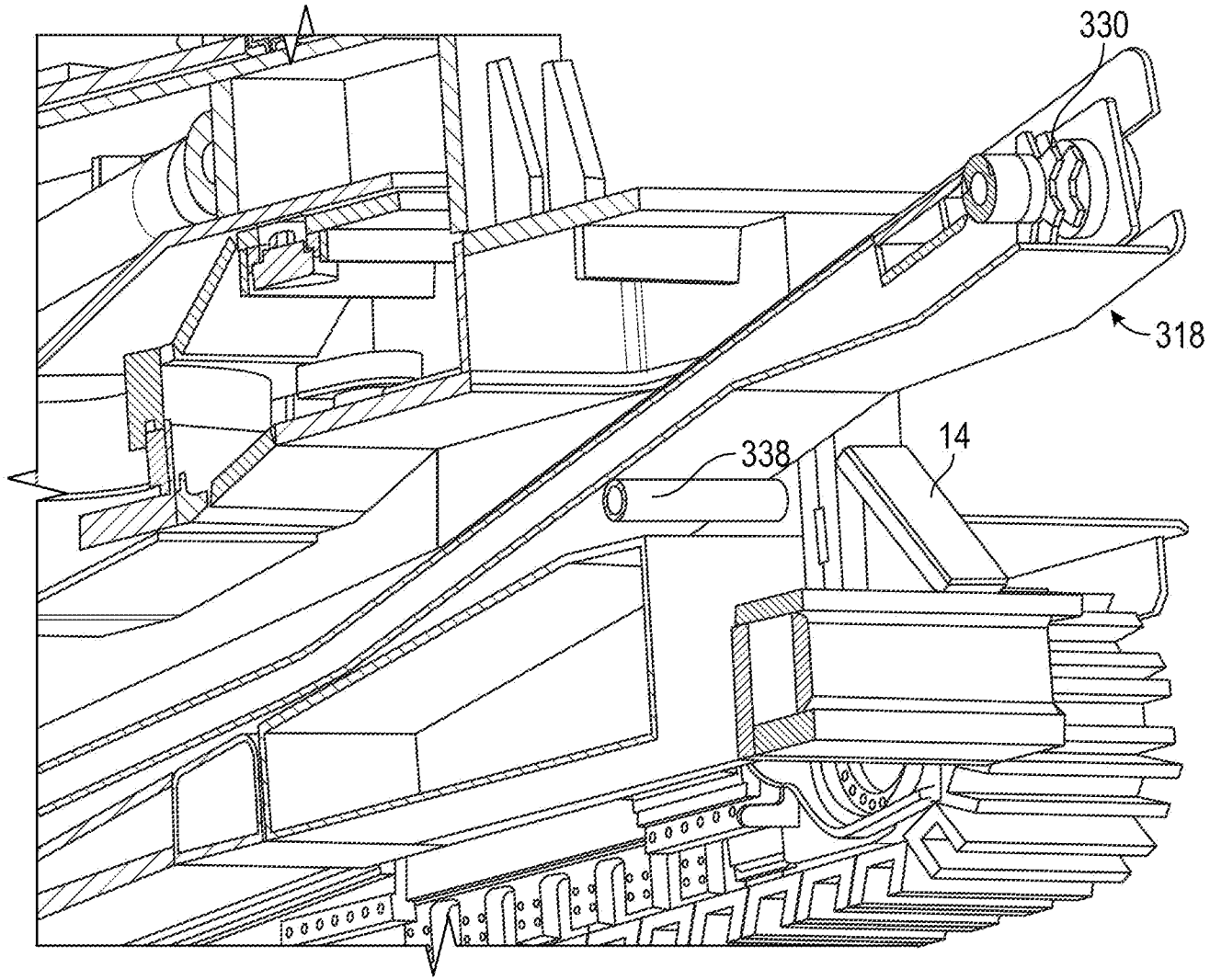
FIG. 24 is a cross-section view of a portion of the mining machine of FIG. 1.

Referring now to FIG. 20, the material handling system 34 includes a gathering head 316 and a conveyor 318. The gathering head 316 includes an apron or deck 322 and rotating arms 326 (FIG. 5). As the machine 10 advances, the cut material is urged onto the deck 322, and the rotating arms 326 move the cut material onto the conveyor 318 for transporting the material to a rear end of the machine 10. The conveyor 318 may be a chain conveyor driven by one or more sprockets 330. In the illustrated embodiment, the conveyor 318 is coupled to the gathering head 316 by a pin joint 334 and is supported for movement relative to the chassis 14 by a roller 338 (FIG. 24). In other embodiments, the arms may slide or wipe across a portion of the deck 322 (rather than rotating) to direct cut material onto the conveyor 318. Furthermore, in other embodiments, the material handling system 34 may also include a pair of articulated arms, each of which supports a bucket for removing material from an area in front of the machine 10 and directing the material onto the deck 322.

Figure 21:
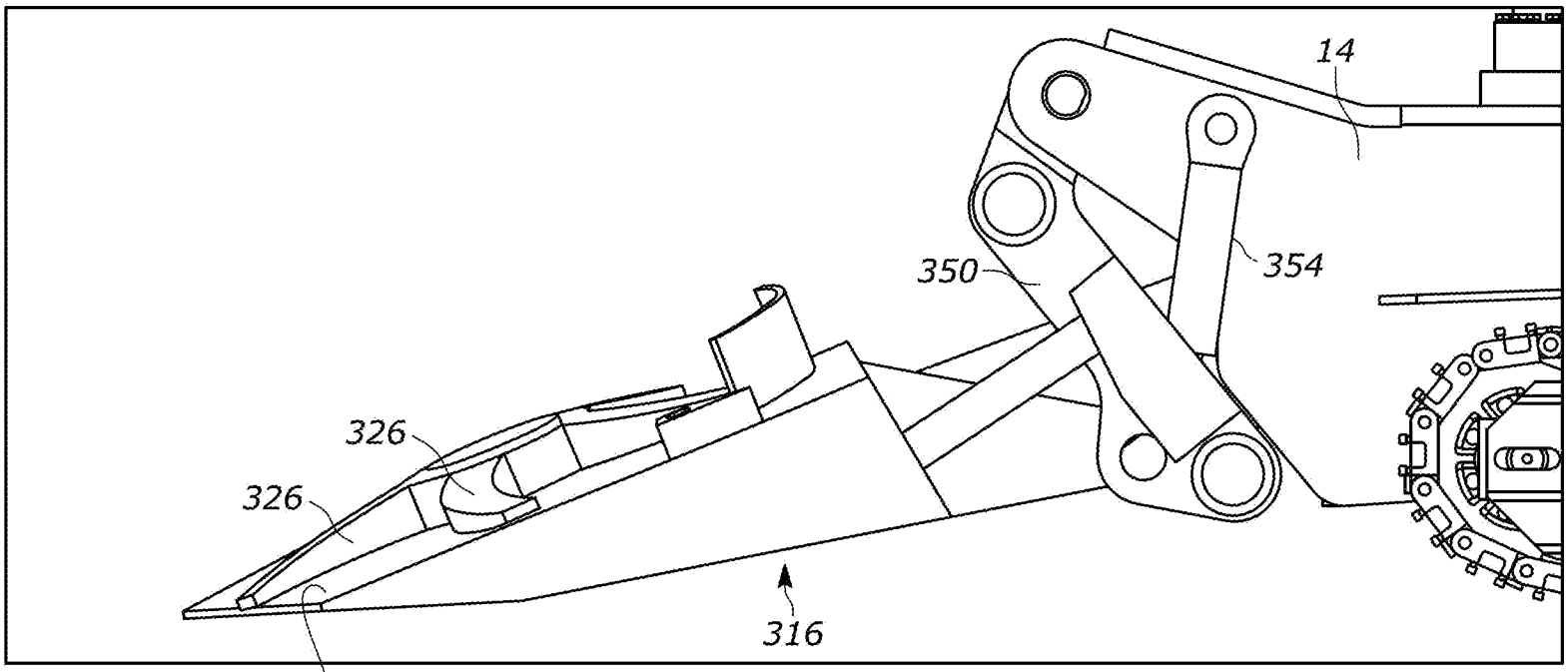
FIG. 21 is an enlarged side view of the mining machine of FIG. 2 with the gathering head in a retracted position.

As shown in FIG. 21, the gathering head 316 and the conveyor 318 are coupled together and are supported for movement relative to the chassis 14. Specifically, the gathering head 316 and conveyor 318 are coupled to the chassis 14 by a link 350 and a sumping actuator 354. Although only one link 350 and sumping actuator 354 is shown in FIG. 20, it is understood that the machine 10 may include a similar link 350 and sumping actuator 354 on each side of the machine 10.

Figure 22:
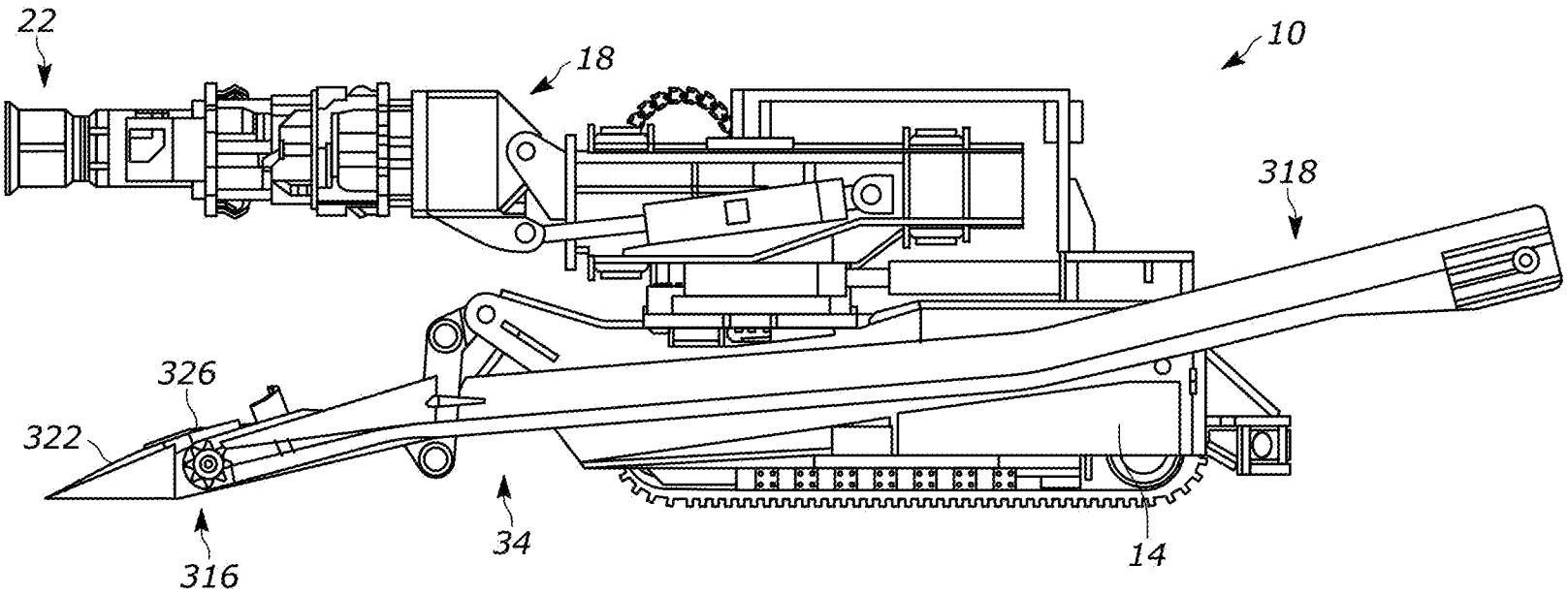
FIG. 22 is a cross-section view of the mining machine of FIG. 5, viewed along section 11-11, with the gathering head in an extended position.
Figure 23:
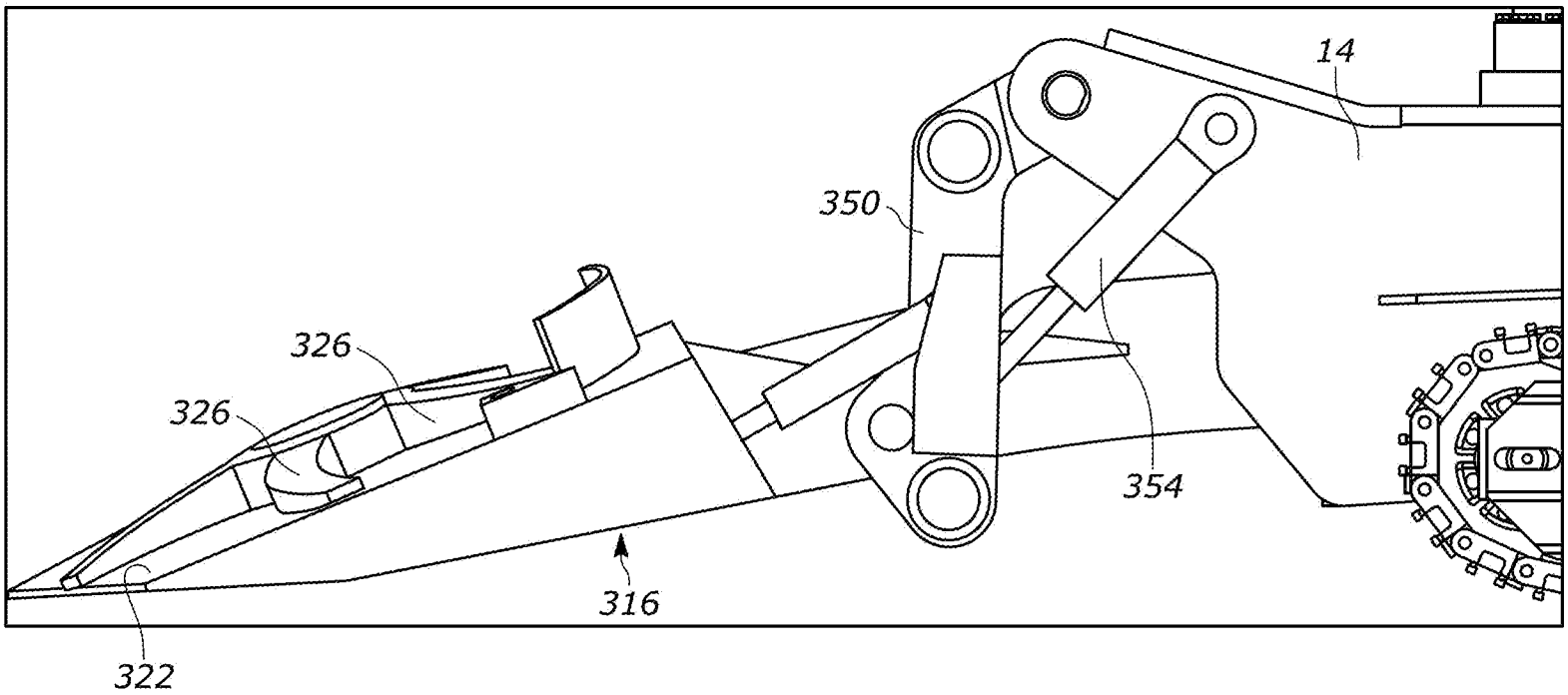
FIG. 23 is an enlarged side view of the mining machine of FIG. 2 with the gathering head in an extended position.

In the illustrated embodiment, a first end of the link 350 is pivotably coupled to the chassis 14 (e.g., proximate an upper end of the front of the chassis 14) and a second end of the link 350 is pivotable coupled to the gathering head 316. The sumping actuator 354 is coupled between the chassis 14 and the link 350 such that operation of the sumping actuator 354 moves the gathering head 316 and conveyor 318 relative to the chassis 14 (movement that is commonly referred to as "sumping"). The gathering head 316 and chassis 14 may be moved between a retracted position (FIGS. 20 and 21) and an extended position (FIGS. 22 and 23), and any intermediate position between the retracted position and the extended position. The stroke of the sumping actuators 354 may be measured with a sensor (e.g., an internal transducer—not shown). In some embodiments, the sumping actuators 354 include floating pistons to maintain the forward edge of the deck 322 against the ground.

In general, the coupling between the wrist portion 74 and the base portion 70 is positioned forward (i.e., distal) with respect to the telescoping coupling between the stationary structure 86 and the movable structure 90. As a result, the articulating portion of the boom 18 is more compact, thereby reducing the area between the cutter head 22 and the forward edge of the gathering head 316. Also, the material handling system 34 is coupled to the chassis 14 independent of the boom 18. As a result, the material handling system 34 can be extended and retracted independent of the boom 18. For example, the boom 18 may be extended relative to the chassis 14, and the material handling system 34 may be extended by a distance that is greater than, less than, or equal to the extension of the boom 18. This provides versatile control of the cutting and gathering operations. In some embodiments, the material handling system 34 can be extended and retracted through a linear distance of approximately 500 mm, and the boom 18 can be extended and retracted through a similar distance.

Although the cutter head 22 has been described above with respect to a mining machine (e.g., an entry development machine), it is understood that one or more independent aspects of the boom 18, the cutter head 22, the material handling system 34, and/or other components may be incorporated into another type of machine and/or may be supported on a boom of another type of machine. Examples of other types of machines may include (but are not limited to) drills, road headers, tunneling or boring machines, continuous mining machines, longwall mining machines, and excavators.

Although various aspects have been described in detail with reference to certain embodiments, variations and modifications exist within the scope and spirit of one or more independent aspects as described. Various features and advantages are set forth in the following claims.

What is claimed is:

1. A rock excavation machine comprising:

a chassis;

a boom supported on the chassis, at least a portion of the boom movable relative to the chassis between a retracted position and an extended position;

a cutting device supported on the boom; and a material handling device supported on the chassis and movable independently relative to the boom, the material handling device movable relative to the chassis between a retracted position and an extended position independent of the boom, the material handling system device including a shovel, at least one arm, and a conveyor, the shovel having a leading edge for receiving material, the at least one arm engaging the material and urging the material toward the conveyor, the conveyor carrying the material toward a rear end of the chassis.

2. The rock excavation machine of claim 1, wherein the boom includes a first portion coupled to the chassis and a second portion pivotably coupled to the first portion, the second portion pivotable about a transverse axis between an upper position and a lower position.

3. The rock excavation machine of claim 2, wherein the material handling device includes a shovel having a leading edge, the material handling device movable independent of the boom to position the leading edge adjacent the cutting device when the boom is in the lower position.

4. The rock excavation machine of claim 3, wherein the material handling device includes a shovel having a leading edge, the material handling device movable independent of the boom to position the leading edge at approximately the same distance from an end of the chassis as the cutting device.

5. The rock excavation machine of claim 1, wherein the chassis includes a turntable supporting the boom for pivoting movement about pivot axis, wherein the boom includes a first structure and a second structure slidable relative to the first structure to move the cutting device toward and away from the turntable.

6. The rock excavation machine of claim 1, wherein the material handling device is coupled to a link pivotably coupled to the chassis, wherein the link is pivoted relative to the chassis by a fluid actuator to move the material handling device between the retracted position and the extended position.

7. The rock excavation machine of claim 1, wherein the chassis includes a turntable supporting the boom for pivoting movement about pivot axis, and further comprising a service support member for supporting service lines, the service support member extending between the chassis and the boom.

8. The rock excavation machine of claim 1, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

9. The rock excavation machine of claim 1, wherein the boom includes first end supported on the chassis, a second end, a first portion adjacent the first end and a second portion adjacent the second end, the second portion supported for movement relative to the first end by a telescopic coupling and pivotable relative to the first portion about an axis, the second portion supporting the cutting device and including a universal joint that allows the cutting device to pivot about at least two axes.

10. The rock excavation machine of claim 1, wherein the boom includes a universal joint that allows the cutting device to pivot relative to the chassis about at least two axes.

11. A rock excavation machine comprising:

a chassis;

a boom supported on the chassis, at least a portion of the boom movable relative to the chassis;

a cutting device supported on the boom; and a material handling device supported on the chassis independently of the boom, the material handling device movable relative to the chassis and independently of the boom, the material handing device being extendible by a distance that is greater than, less than, or equal to an extension of the boom, the material handling system device including a shovel, at least one arm, and a conveyor, the shovel having a leading edge for receiving material, the at least one arm engaging the material and urging the material toward the conveyor, the conveyor carrying the material toward a rear end of the chassis.

12. The rock excavation machine of claim 11, wherein the material handling device is coupled to a link pivotably coupled to the chassis, wherein the link is pivoted relative to the chassis by a fluid actuator to move the material handling device between a retracted position and an extended position.

13. The rock excavation machine of claim 11, wherein the boom includes a universal joint that allows the cutting device to pivot about at least two axes.

14. The rock excavation machine of claim 13, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

15. A rock excavation machine comprising:

a chassis including a turntable;

a boom supported by the turntable such that the boom is pivotable about a pivot axis, the boom including a first portion coupled to the turntable and a second portion pivotably coupled to the first portion about a pivot joint, the second portion of the boom movable relative to the chassis between a retracted position and an extended position, the second portion including a universal joint;

a cutting device supported on the second portion such that the universal joint allows the cutting device to pivot about at least two axes; and a material handling device supported on the chassis independently of the boom and including a shovel with a leading edge, the material handling device movable independent of the boom to position the leading edge at approximately the same distance from an end of the chassis as the cutting device.

16. The rock excavation machine of claim 15, wherein the material handling device is coupled to a link pivotably coupled to the chassis, wherein the link is pivoted relative to the chassis by a fluid actuator to move the material handling device relative to the chassis.

17. The rock excavation machine of claim 15, wherein the material handling system further includes at least one arm and a conveyor, and wherein the at least one arm engages the material and urging the material toward the conveyor and the conveyor carries the material toward a rear end of the chassis.

18. The rock excavation machine of claim 15, wherein the cutting device includes a cutting disc and an excitation device, the excitation device including an eccentric mass supported for rotation in an eccentric manner and positioned proximate the cutting disc, wherein rotation of the eccentric mass induces oscillation of the cutting device.

* * * * *